United States Patent [19]

Aoki et al.

[11] 4,267,762

[45] May 19, 1981

[54] ELECTRONIC MUSICAL INSTRUMENT WITH AUTOMATIC ARPEGGIO PERFORMANCE DEVICE

[75] Inventors: Eiichiro Aoki; Tsutomu Suzuki, both of Hamamatsu, Japan

[73] Assignee: Nippon Gakki Seizo Kabushiki Kaisha, Hamamatsu, Japan

[21] Appl. No.: 870,008

[22] Filed: Jan. 16, 1978

[30] Foreign Application Priority Data

Jan. 19, 1977 [JP] Japan ..... 52-4672

[51] Int. Cl.[3] ..... G10H 1/28; G10H 1/38; G10H 5/00

[52] U.S. Cl. ..... 84/1.03; 84/1.24; 84/DIG. 2; 84/DIG. 22

[58] Field of Search ..... 84/1.01, 1.03, 1.17, 84/1.24, DIG. 2, DIG. 22

[56] References Cited

U.S. PATENT DOCUMENTS

| | | | |
|---|---|---|---|
| 3,718,748 | 2/1973 | Bunger | 84/1.24 |
| 3,842,182 | 10/1974 | Bunger | 84/1.03 |
| 3,842,184 | 10/1974 | Kniepkamp et al. | 84/1.01 |
| 3,854,366 | 12/1974 | Deutsch | 84/1.24 |
| 4,059,039 | 11/1977 | Carlson | 84/1.01 |
| 4,080,862 | 3/1978 | Hiyoshi et al. | 84/1.24 |
| 4,106,385 | 8/1978 | Roberts | 84/1.24 |
| 4,120,225 | 10/1978 | Dietrich et al. | 84/1.03 |
| 4,120,226 | 10/1978 | Finch | 84/1.03 |
| 4,127,048 | 11/1978 | Schmoll | 84/1.03 |
| 4,148,241 | 4/1979 | Morez et al. | 84/1.03 |
| 4,154,131 | 5/1979 | Studer et al. | 84/1.03 |
| 4,156,379 | 5/1979 | Studer | 84/1.03 |
| 4,158,978 | 6/1979 | Hiyoshi et al. | 84/1.03 |
| 4,171,658 | 10/1979 | Aoki et al. | 84/1.03 |

*Primary Examiner*—Stanley J. Witkowski
*Attorney, Agent, or Firm*—Spensley, Horn, Jubas & Lubitz

[57] ABSTRACT

An electronic musical instrument is of a type wherein a key depression brings forth the generation of a key code identifying the depressed key in a digital representation, and the key code designates the tone to be produced. Based on the single key code of the depressed key, there are produced plural key codes indicating plural tones which are in predetermined musical interval relation with the depressed key to constitude a chord. The original key code and the produced key codes are utilized one after another successively to perform an automatic arpeggio.

10 Claims, 17 Drawing Figures

PRIMARY MEMORY
SECONDARY MEMORY
FROM KEY CODER 12
(KC)
RT
LK
KO
SC
IC
18

1 BIT-TIME
(24μs)

(a) SY12
12 BIT-TIMES
(b) 87–12
B C C# D D# E F F# G G# A A# B C C#
NOTE ENCODER 102
(c)
N1*
N2*
N3*
N4*
0 0 1 0
1 0 0 1
1 0 0 0
1 0 0 0

TIME
(a) SC
(b) SY12
(c) RT
(d) EQ
(e) EQ1
(f) EQM
(g) 127
(h) 146
(i) 163
(j) 164
(k) LE
(l) LE1
(m) LE2
(n) LE3
(o) LKE
TIME

242
LATENCY TIME SETTING CIRCUIT
WR
233
LE·DS
S/R (12/1)
237
234
240
241
238
235
239
243
KONR
1
LKDP
251
LKD
250
DIFF.
CPL
COUNT
CPF
TEP
246
245
244
247
ADDER
S/R (12/3)
KONR
252
CARRY
1
274
CON
290
291
S/R (10/1)
CCF
281
288
LE11
287
289
286
OCTV1
OCTV2
285
CPF
FF1
FF2
FF3
FF

OCTAVE MEMORY
ADDER
OCTAVE COUNTER
COUNT
RESET
OCTV1
OCTV2
CON
KONR
TRIG
OSE1
OSE2
OVF
OSEQ
ZR
OCRE
UM
TM
TP
WR
U/D

ELECTRONIC MUSICAL INSTRUMENT WITH AUTOMATIC ARPEGGIO PERFORMANCE DEVICE

BACKGROUND OF THE INVENTION

This invention relates to an electronic musical instrument in which a plurality of tones are automatically successively produced by depressing a single key, thereby to automatically provide a performance effect such as arpeggio.

In an automatic arpeggio device known in the art, the tones of a plurality of keys depressed in the keyboard are successively produced one after another. In this conventional automatic arpeggio device, the timing of production of tones for the depressed key is merely controlled, and the tone pitch of the tone for the depressed key may be shifted by the octave, but a tone or tones completely different from the tone of the depressed key are never produced. Accordingly, when it is required to automatically perform, in arpeggio, tones composing a chord, it is necessary to depress all the keys of the notes composing the chord.

SUMMARY OF THE INVENTION

Accordingly, an object of this invention is to provide an electronic musical instrument in which merely by depressing one key in the keyboard, tones composing a chord whose fundamental note is that of the depressed key are automatically performed in an arpeggio form.

Provided according to this invention is an electronic musical instrument in which according to the information representative of a key depressed in the key board, key information such as a key code representing tones which are in predetermined interval relation to the tone of the depressed key i.e. subordinate tones, (hereinafter referred as "sub-tones" when applicable), are automatically formed, and the key information is selected sequentially one at a time at predetermined time intervals, whereby the tones corresponding to the information thus selected are produced.

If the tones are produced one by one at predetermined time intervals, an arpeggio-like effect can be obtained. An arpegio-like performance carried out with the electronic musical instrument of this invention will be referred to as "a chord pyramid performance" hereinafter, when applicable, because of this performance the tone pitches of produced tones are increased and then decreased in the form of a pyramid.

According to this invention, in the case where key information as to tones which are in predetermined interval relation to the tone of a depressed key is formed, digital key codes corresponding respectively to the keys in the keyboard are employed, and values corresponding to desired intervals with respect to the key code of the tone of the depressed key are obtained through arithmetic operation, thereby to provide the key codes of the sub-tones. The key codes of plural tones thus obtained are sequentially detected in the order of magnitude of their contents, and this detection is repeated as required, and simultaneously a musical tone corresponding to a key code selected is produced.

The nature, principle and utility of this invention will come more apparent from the following description and the appended claim when read in conjunction with the accompanying drawings, in which like parts are designated by like reference numerals or characters.

DETAILED DESCRIPTION OF THE INVENTION

One preferred example of an electronic musical instrument according to this invention will be described with reference to the accompanying drawings.

Figure 1:
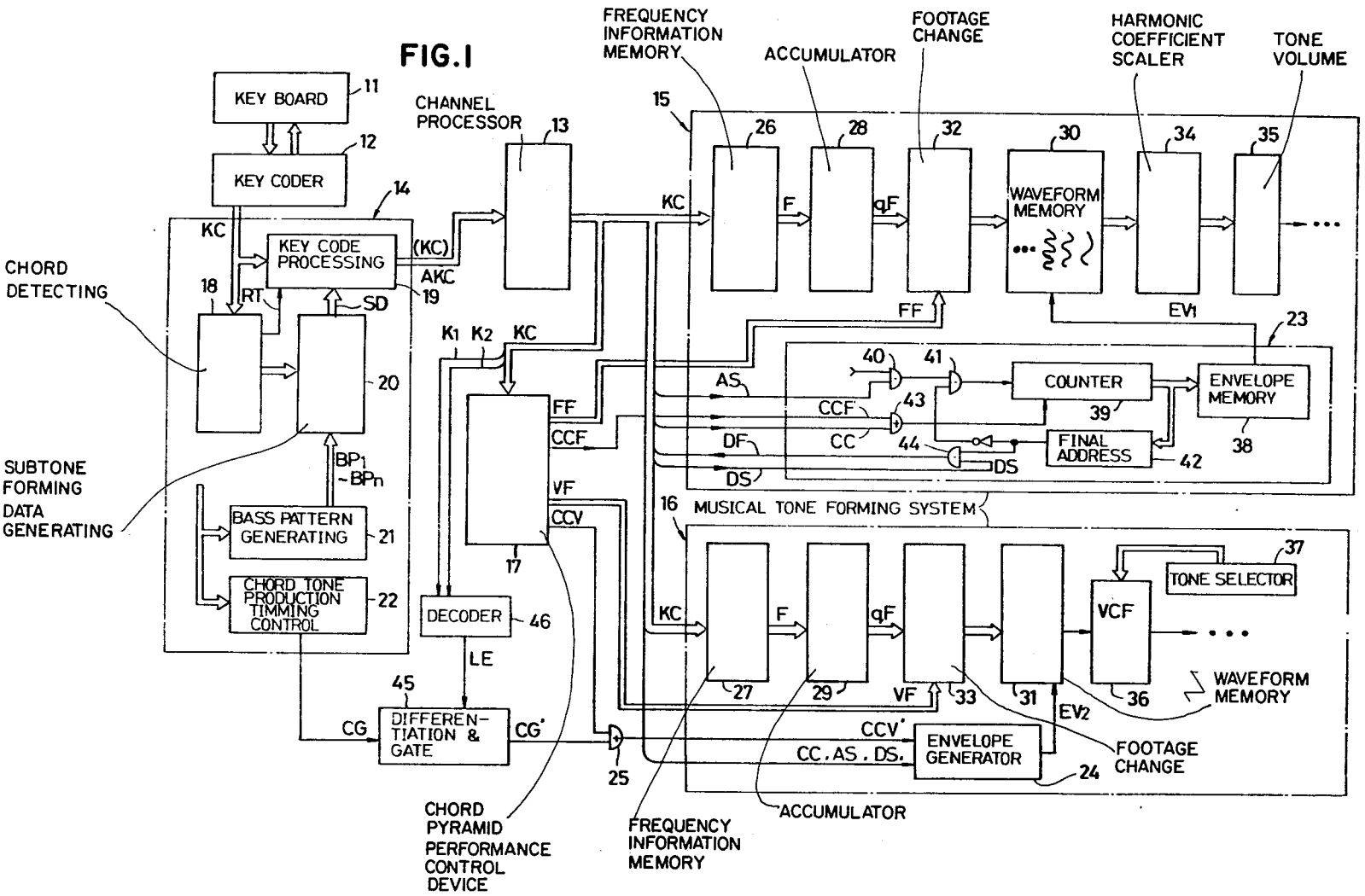
FIG. 1 is a block diagram schematically illustrating one example of an electronic musical instrument according to this invention.

Referring to FIG. 1, a keyboard 11 comprises an upper keyboard, a lower keyboard, and a pedal keyboard. A key coder 12 operates to detect the operation of a key switch provided for each key in the keyboard 11 to produce a key code KC representative of the key depressed. In this example, it should be noted that an automatic performance according to this invention is carried out in response to key depressions in the lower keyboard. A key coder disclosed in the specification of U.S. Patent Application Ser. No. 714,084 "CHANNEL PROCESSOR" now U.S. Pat. No. 4,114,495 may be employed as the key coder 12. The key coder 12 successively and repeatedly produces key codes KC corresponding to a depressed key or keys. In order to identify or distinguish the keys in the keyboard 11, a key code KC as shown in Table 1 is used. The key code KC is a 9-bit code signal consisting of a keyboard code $K_1$, $K_2$ representative of the kind of a relevant keyboard, an octave code $B_1$, $B_2$, $B_3$ representative of an octave range, and a note code $N_1$, $N_2$, $N_3$, $N_4$ representative of a note (twelve notes per octave being employed).

TABLE 1

| Key | | Key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 1 | | | | | | | |
| Octave range | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |
| Start code | (SC) | 0 | 0 | 0 | 0 | 0 | 1 | 1 | 1 | 1 |

The binary values of the octave codes $B_1$, $B_2$, $B_3$ and the note codes $N_1$, $N_2$, $N_3$, $N_4$ correspond to tone pitches, respectively. More specifically, whenever the binary value of the octave code $B_1$–$B_3$ increases by one, the octave range is increased by one octave. On the other hand, as the binary balue of the note code $N_1$–$N_4$ increases, the tone pitch of the note represented thereby is increased; however, it should be noted that the weights of the binary value are not always exactly in correspondence to the tone pitch. As is apparent from Table 1, data "0011", "0111", "1011" and "1111" are not included in Table 1 as to the note code $N_4$–$N_1$. This is to facilitate key code processing for subtone formation described later. In general, twelve notes in one octave are arranged in the order of C, C#, D . . . , and B with note C as the lowest note. However, in the case of Table 1, if the octave code $B_1$–$B_3$ is maintained unchanged, a tone pitch order of C#, D . . . B and C is established. This means that with the same octave code $B_1$–$B_3$ the octave range of note C is higher than the other octave rnages of C#-B. For instance, if the code $B_3$, $B_2$ . . . $N_2$, $N_1$ is "0001110", it represents note $C_2$; and if the code is "0010000", it represent note $C_2$#. Furthermore, if the code $B_3$ . . . $N_1$ is "1011101", it represents note $B_6$; and if the code is "1011110", it represents note $C_7$.

Incidentally, in the key coder disclosed in the specification of U.S. Pat. No. 4,114,495, only the key codes KC of keys being depressed are extracted, and are successively outputted with a time width of 24 microseconds per key code. Upon release of a key in the keyboard 11, the provision of its key code is suspended. In order that a channel processor 13 described later detects the key code the provision of which has been suspended (or the key which has been released), start codes SC are substantially periodically produced by the key coder 12. The content of the start code SC is as indicated in Table 1. The generation time width of the start code SC is similar to that of the key code KC, or 24 microseconds, and the generation period of the start code SC is, for instance, of the order of 5 ms (milliseconds). When the start code SC is being produced, the key code KC is not generated. In the channel processor 13, when the key codes which have been generated are not generated within one period of the start code SC at all, it is decided that the keys concerning the key codes have been released.

Figure 2:
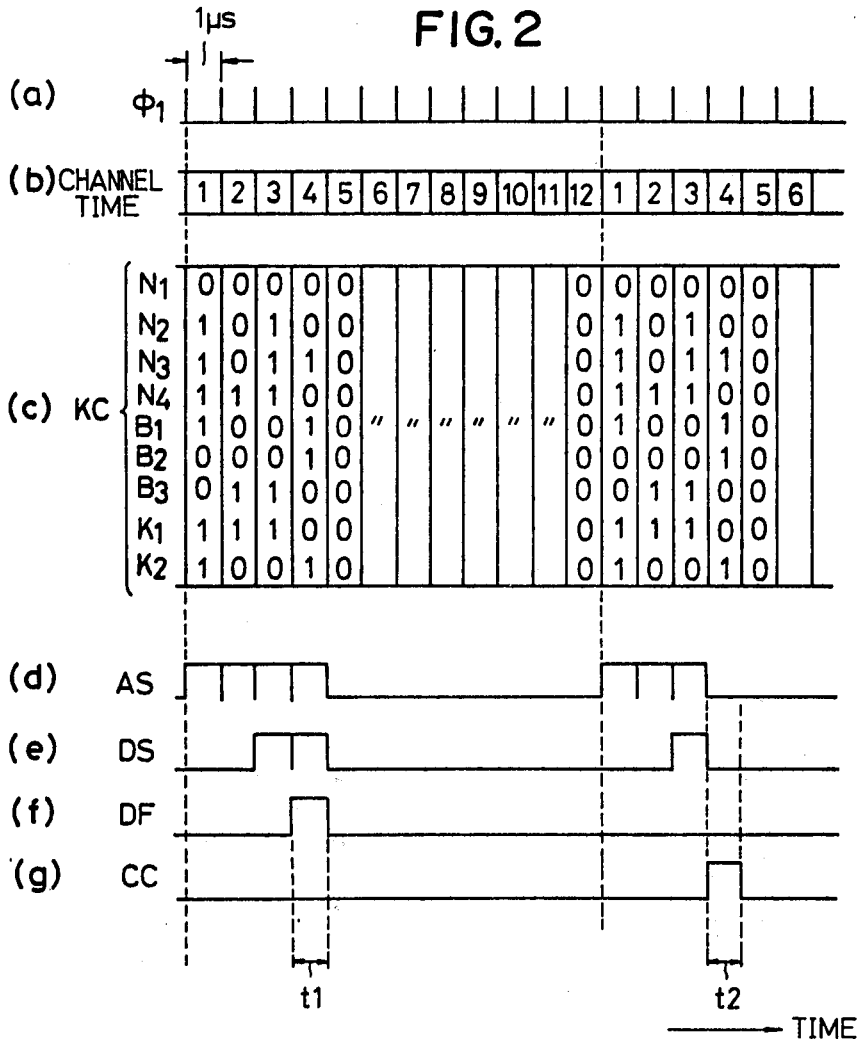
FIG. 2 is a timing chart for a description of the tone production assignment effected in a time division manner in the example shown in FIG. 1.

The channel processor 13 receives key code data from the key coder 12 (or through an automatic bass chord performance control device 14 described later) to assign the tone production of a key corresponding to this key code data to one of the channels the number of which is equal to the maximum number of simultaneous tone productions (for instance twelve tones). The channel processor 13 has memory positions in correspondence to the channels. In the channel processor 13, a key code data KC for a key is stored in a memory position which corresponds to a channel to which the tone production of the key has been assigned, and the key code data thus stored are multiplexed in time division and outputted separately according to the time of channels. Shown in the part (a) of FIG. 2 are main clock pulses $\phi_1$ for controlling time division operation. The period of the main clock pulses $\phi_1$ is, for instance, one microsecond. Since the number of channels is twelve, time slots, each having a time width of one microsecond and being divided successively by the main clock pulses $\phi_1$, are correspondent to the first through twelfth channels, respectively. As indicated in the part (b) of FIG. 2, the time slots will be referred to as "the first through twelfth channel times" when applicable. The channel times occur cyclically. Therefore, the key codes KC representing the keys whose tone productions are assigned by the channel processor 13 are outputted successively in a time division manner in coincidence with the assigned channel times. For instance, if it is assumed that note C in the second octave range of the pedal keyboard is assigned to the first channel, note G in the fifth octave range of the upper keyboard is assigned to the second channel, note C in the fifth octave range of the upper keyboard is assigned to the third channel, note E in the fourth octave range of the lower keyboard is assigned, and no tone production is assigned to the fifth through twelfth channel; then the contents of the key codes KC outputted in a time division manner in synchronization with the respective channel times by the channel processor 13 are as indicated in the part (c) of FIG. 2. In this case, all the outputs of the fifth through twelfth channels are "0".

Furthermore, the channel processor 13 outputs in a time division manner attack start signals (or key-on signals) AS in synchronization with the respective channel times, which signals represent that the tone production should be effected in the channels to which the depressed key have been assigned. In addition, the channel processor 13 outputs in a time division manner decay start signals (or key-off signal) DS in synchronization with the respective channel times, which signals represent that the key or keys whose tone production has been assigned to the respective channels have been released (or that supply of the key codes KC from the key coder 12 or supply of the key code AKC from the automatic bass chord performance control device 14 has ceased). These signals AS and DS are utilized for amplitude envelope control (tone production control) of musical tones. Moreover, the channel processor 13 receives a decay finish signal DF from an envelope generator 23, which represents the fact that tone production in a relevant channel has been finished, and then the channel processor 13 outputs a clear signal CC in response to the decay finish signal DF. The clear signal CC is employed to clear various storages concerning a relevant channel and to completely cancel the tone production assignment. If it is assumed with resoect to the example indicated in the part (c) of FIG. 2 that keys assigned to the first and second channels are being depressed (the key code KC or AKC is being provided), key assigned to the third and fourth channels have been released and the tone productions thereof are being decayed (the key code KC or AKC is not being provided), the tone production finish signal DF is provided at the time slot $t_1$ in the fourth channel, and the clear signal CC occurs in twelve channel times after the time slot $t_1$, i.e., at the time slot $t_2$; then the signals AS, DS, DF and CC are provided as indicated in the parts (d) through (g) of FIG. 2. At the time slot $t_2$ the clear signal CC is provided, and therefore the attack start signal AS and the decay start signal DS are eliminated. Simultaneously, the key code KC for the fourth channel time in the part (c) of FIG. 2 is also eliminated; however, it is left as it is, for convenience in description.

The key code KC, the attack start signal AS and the decay start signal DS which have been outputted by the channel processor 13 are applied to musical tone forming systems 15 and 16 and a chord pyramid performance control device 17.

The automatic bass chord performance control devicd 14 is connected between the key coder 12 and the channel processor 13. This automatic bass chord performance control device 14 operates to receive the key codes KC of key selected (depressed) in the lower keyboard from the key coder 12, thereby to form a key code AKC corresponding to a base tone in automatic bass performance or to form a key code AKC corresponding to chord composing tones in automatic chord performance in response to the key code KC thus received. In other words, in response to the key code KC of a key depressed in the keyboard 11 the automatic bass chord performance control device 14 automatically form the key code AKC of a key, which actually is not depressed, as if it is truely depressed, and supplies the key code thus formed to the channel processor 13.

In the ordinary automatic base chord performance, a plurality of keys in the lower key-board are depressed in the form of a chord, whereby the tones of the keys are produced as a chord tone and an automatic bass tone is formed according to the chord. In this operation, a chord detecting section 18 receives the key code KC concerning the lower keyboard to detect the fundamental note of the chord formed by one or plural keys depressed in the lower keyboard and the kind of the chord (such as major, minor, and seventh). However, in this example, the chord pyramid performance control device 17 is operated by utilizing a single finger function in automatic bass chord performance, thereby to practice this invention. Accordingly, the single finger function is very important in this example. When the single finger function is performed, the chord detecting section 18 selects one key depressed in the lower keyboard (in general, only one key being depressed with the single finger function) and applies it, as a fundamental note data RT, to a key code processing section 19. In addition, with the single finger function, data designating the kinds of chord are provided by switches (not shown), and a subtone forming data generating section 20 generates a subtone forming data SD corresponding to a predetermined interval according to the data specifying a kind of chord. In the automatic bass chord performance other than that with the single finger function, the subtone forming data SD is provided in accordance with the kind of chord detected by the chord detecting section 18. This subtone forming data SD has a value corresponding to the note interval. In the case of automatic bass tones, timing with which a subtone forming data SD corresponding to an interval should be produced is controlled by bass pattern pulses $BP_1$ through $BP_n$ which are outputted by a bass pattern generating section 21 according to a rhythm selected by a rhythm selecting switch (not shown). The subtone forming data SD for forming automatic chord tones in the single finger function is applied to key code processing section 19 with suitable timing. The key code processing section 19 operates to change the value of the key code KC of a note corresponding to a root detected by the chord detecting section 18 according to the value of the aforementioned subtone forming data SD, thereby to form the key codes AKC of the automatic bass tone and the automatic chord tone. This changing operation is carried out through calculation. The key code $K_1$, $K_2$ representative of the pedal keyboard is added to the key code AKC of the automatic bass tone, while the key code $K_1$, $K_2$ representative of the lower keyboard is added to the key code AKC of the automatic chord tone in the single finger function. The instrument is so designed that when the key codes AKC thus processed are applied to the channel processor 13, application of the key code KC outputted by the key coder 12 is suspended. It goes without saying that the key code KC representative of the keyboard (for instance the upper keyboard) not employed for automatic bass performance is applied, as it is, to the channel processor 13 and that when the automatic bass chord performance control device 14 is inoperable the output KC of the key coder 12 is applied, as it is, to the channel processor 13.

The tone production timing of an automatic bass tone is determined with the aid of the bass pattern pulses $BP_1$ through $BP_n$. In other words, as long as the bass pattern pulses $BP_1$ through $BP_n$ are provided, the key code AKC of the automatic bass tone is maintained applied to the channel processor 13, as a result of which the tone production assignment thereof is effected. The tone production timing of a chord tone is determined with the aid of a chord tone production timing signal CG provided by a chord tone production timing control section 22. This chord tone production timing signal CG is produced in accordance with a rhythm selected by the performer, and is applied to an envelope generator 24 in the second musical tone forming system 16, thereby to control the amplitude envelope of a lower keyboard tone provided by the musical tone forming system 16. As a result, a plurality of lower keyboard tones are intermittently but simultaneously produced; that is, the performance is such that the chord tone is chopped. In production of a chord tone, the tone production assignment of a lower keyboard tone which will be chord tone is continuously effected by the channel processor 13, and the amplitude envelope of this lower keyboard tone is controlled by the chord tone production timing signal CG so as to intermittently produce the chord tone.

The chord pyramid performance control device 17 automatically performs a chord pyramid performance similar to arpeggio. In this control device 17, lower keyboard key codes in the key codes KC supplied thereto by the channel processor 13 are selected in the order of the tone pitch at each predetermined tone production timing so as to provide a single chord pyramid tone production command signal CCF and a single chord pyramid tone production command signal CCV (each having a pulse width of one microsecond) in synchronization with the channel time to which the key code KC thus selected is assigned. The chord pyramid tone production command signal CCF is applied to the envelope generator 23 in the first musical tone forming system 15, while the other command signal CCV is applied through an OR circuit 25 to the envelope generator 24 in the second musical tone forming system 16. In the musical tone forming systems 15 and 16, the amplitude envelopes of musical tones are controlled with the aid of the command signals CCF and CCV, so that only the lower keyboard tones of channels for which the command signals CCF and CCV have occurred are produced. Accordingly, in the case where the chord pyramid performance control device 17 has been operated, the tone of keys depressed in the lower keyboard in the keyboard 11 or tones concerning the automatic chord performing key codes AKC automatically provided by the automatic bass chord performing key codes AKC automatically provided by the automatic bass chord performance control device 14 are automatically performed in an arpeggio system. In the automatic chord pyramid performance (or automatic arpeggio performance) employing the chord pyramid performance control device 17, it is possible to automatically switch the octave of a producing tone, and octave switching signal FF and VF representative of octave switching amounts are outputted by the control device 17. The tone pitch of the chord pyramid tone (or arpeggio tone) is switched by the octave in accordance with the values of the octave switching signals FF and VF.

In the musical tone forming systems 15 and 16, the key code KC supplied thereto by the channel processor 13 is employed as an address specifying signal for reading the numerical information F which is inherent in the musical tone frequency of a tone corresponding to the key code KC, out of frequency information memory devices 26 and 27.

Each of the frequency information memory device 26 and 27 is made up of, for instance, a read only memory in which frequency information F(constant) corresponding to the key codes KC for the keys have been stored in advance. Upon application of the key code KC, each device 26 or 27 operates to read the frequency information F which has been stored in the address which is specified by the key code KC. In each of accumulators 28 and 29, the pieces of frequency information F are regularly and successively accumulated so as to sample the amplitude of a musical tone waveform at predetermined time intervals, and accordingly the frequency information F is a digital value proportional to the musical tone frequency of the relevant key.

If the value of a musical tone frequency is specified with a predetermined sampling rate, the value of the frequency information F is determined. For instance, with each of the accumulators 28 and 29, if it is assumed that when a value qF (where $q=1, 2, 3 \ldots$) obtained by successively accumulating pieces of frequency information F reaches 64 in decimal notation, sampling one musical tone waveform (tone source waveform) is completed, and that this accumulation is carried out for every twelve microseconds during which one cycle of all channel times is completed, then the value of the frequency information F can be determined from the following equation:

$F=12\times 64\times f\times 10^{-6}$, where f is the frequency of a musical tone.

The frequency information F is stored in each of the frequency information memory devices 26 and 27 in correspondence to the frequency f from which it can be obtained.

Each of the accumulators 28 and 29 is a counter for accumulating pieces of frequency information F in the channels at a predetermined sampling rate (at a speed of 12 microseconds for each channel), which obtains an accumulation value qF to advance the phase of a musical tone waveform to be read out for every sampling time (12 microseconds). When the accumulation value qF reaches 64 in decimal notation, the value of each of the accumulators 28 and 29 overflows to return to "0", thus completing the reading of one waveform. In order to accumulate the data F of the channels in a time division manner, each of the accumulators 28 and 29 is made up of a plural-bit adder and a 12-stage shift register the number of stages of which is equal to the number of channels.

In each of musical tone waveform memories 30 and 31, a tone source waveform is sampled at a plurality of sampling points (for instance 64 sampling points), and amplituded values obtained at the sampling points are successively stored in the respective addresses. The output, or value qF, of each of the accumulators 28 and 29 will become an input for specifying an address to be read out of each of the memories 30 and 31. In response to the values qF applied in a time division manner separately according to the channels, the musical tone waveforms (tone source waveforms) of tones assigned to the channels are read in a time division manner from the waveform memories 30 and 31.

Footage change circuit 32 and 33 are connected between the accumulators 28 and 29 and the musical tone waveform memories 30 and 31, respectively. The footage change circuits 32 and 33 are so designed that the binary bit positions of the accumulation values qF applied thereto by the accumulators 28 and 29 can be suitably shifted in accordance with the octave switching signals FF and VF, respectively. In the case that octave switching is not requested, the outputs qF of the accumulators 28 and 29 are, as they are, applied to the waveform memories 30 and 31, respectively. However, in the case that octave switching is requested by the signals FF and VF, the value qF are increased by a factor 2, 4, 8 or so on according to the octave switching amounts and are then applied to the waveform memories 30 and 31, respectively. As the values qF are increased by a factor 2, 4, 8 or so on by the footage change circuits 32 and 33, the sample point amplitudes in the addresses which are advanced two-times, four-times, eight-times farther than the addresses which are specified actually by the values qF are read out of the waveform memories 30 and 31, respectively. This means that the musical tone frequencies obtained are increased by a factor 2, 4, 8 or so on and that the pitches of tones produced are switched higher by one octave, two octaves, three octaves or so on.

The octave switching signals FF and FV for specifying the octave switching amounts are applied to the foot change circuits by the chord pyramid performance control circuit 17.

The signal FF is to specify the number of switching octaves for the musical tone forming system 15, while the signal FV is to specify the number of switching octaves for the musical tone forming system 16, so that chord pyramid performances can be carried out separately in the two systems 15 and 16.

In the musical tone forming system 15, the musical tone waveform memory 30 comprises a plurality of musical tone waveform memories which have stored harmonic waveforms, respectively, and the harmonic waveforms are simultaneously read out in response to address signals provided through the foot change circuit 32 by the accumulator 28. The musical tone forming system 15 further comprises a harmonic coefficient scaler 34 which is a circuit for individually controlling the relative amplitudes of the harmonic waveforms. In this circuit, the harmonic waveforms amplitude-controlled are subjected to addition so as to provide a variety of musical tone signals having predetermined tone colors. In a tone volume circuit 35 provided at the output side of the harmonic coefficient scaler 34, a desired one out of the musical tone signals having various tone colors outputted by the harmonic coefficient scaler 34 is selected. Thus, in the musical tone forming system 15, a musical tone having a desired tone color is obtained according to the harmonic composition system.

In the other musical tone forming system 14, tone source waveforms (such as for instance saw tooth waveforms) having a number of harmonic components are stored in the musical tone waveform memory 31, and a tone source waveform read out of the waveform memory 31 is applied to a voltage-controlled filter (VCF) 36 where it is subjected to tone color control. The tone color control characteristic of the voltage controlled filter 36 is varied in accordance with a desired tone color selected by a tone selector 37.

Musical tone productions in the musical tone forming systems 15 and 16 are controlled by envelope waveform signals $EV_1$ and $EV_2$ provided by the envelope generators 23 and 24, respectively. In other words, in the musical tone forming systems 15 and 16, tone source waveform signals having maximum amplitude according to the levels of the envelope waveform signals $EV_1$ and $EV_2$ are read out of the musical tone waveform memories 30 and 31, respectively.

One example of the arrangement of the envelope generator 23 or 24 is as indicated in the block 23. In an envelope memory 38, the amplitude envelope of a musical tone corresponding to the variation with time of a tone volume is stored in advance, and the reading address is advanced according to the count output of envelope counter 39. Clock pulses for advancing the contents of the envelope counter 39 (or for advancing the reading address in the envelope memory 38) are applied to the counter 39 through AND circuits 40 and 41. The attack start signal AS is applied to the other input of the AND circuit 40. When the count content of the counter 39 reaches the final address of the envelope memory 38, an output "1" is produced by a final address detecting logic 42, thereby to block the clock pulse delivery of the AND circuit 41. When the chord pyramid tone production instruction signal CCF is applied through an OR circuit 43 to the counter 39, the counter 39 is cleared, and the reading address of the envelope memory 38 becomes "0". When the level of the signal CCF is lowered to "0", the counter 39 starts its counting operation from address 0 and the envelope signal $EV_1$ is read out of the enveloped memory, in the case where the attack start signal AS has been applied to the counter 39.

In chord pyramid performance, the tone production timing is controlled by the chord pyramid tone production instruction signal CCF (or CCV). However, when the chord pyramid performance is not carried out (in the case of a normal performance), the tone production timing is controlled by the clear signal CC. In other words, when the level of the clear signal CC is lowered from "1" to "0" while the level of the attack start signal AS is raised from "0" to "1" by key depression, the counter 39 starts its operation and the envelope signal $EV_1$ is produced. If the decay start signal representing key release is present when the final address N is detected by the final address detecting logic 42, the decay finish signal DF is provided through an AND circuit 44 and is applied to the channel processor 13.

It goes without saying that the envelope counter 39 is so designed as to be able to carry out its counting operation in a time division manner, and therefore the envelope signals $EV_1$ and $EV_2$ are produced in a time division manner separately according to the channels.

The envelope generator 24 may be one similar in arrangement to the above-described envelope generator 23. In the envelope generator 24, the output signal CCV' (chord pyramid tone production instruction signal CCV) of an OR circuit 25 is employed to clear the envelope counter (39).

Figure 3:
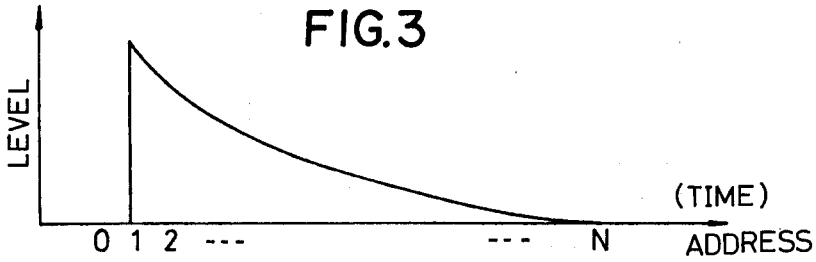
FIG. 3 is a graphical representation indicating one example of a percussive envelope waveform.

In each of the envelope generators 23 and 24, a percussive envelope waveform as shown in FIG. 3 is generated.

In the case of the percussive envelope waveform shown in FIG. 3, when the clear condition of the counter 39 is released and the count value of the counter 39 becomes "1", the maximum level of address 1 is read out. Thereafter, the level is decayed continuously until final address N is reached. At this final address N, the level becomes zero and the tone decays.

Figure 4:
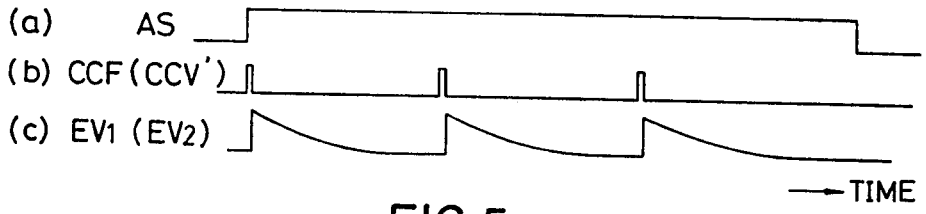
FIG. 4 is a timing chart for briefly describing the generation of a percussive envelope waveform which is effected according to a chord pyramid tone production instruction signal.

FIG. 4 indicates a state where the percussive envelope signal $EV_1$ (or $EV_2$) is produced according to the chord pyramid tone production instruction signal CCF (or CCV'), with respect to only one channel time. When a single signal CCF(or CCV') as shown in the part (b) of FIG. 4 is provided, the envelope counter 39 is cleared, and the count value becomes 0. Accordingly, if the attack start signal AS has been provided (the part (a) of FIG. 4), the count pulse is applied to the envelope counter 39, and the level of the signal CCF (or CCV') is lowered to "0", while it is counted by the counter 39, and the percussion envelope signal $EV_1$ (or $EV_2$) is produced. At the final address, the AND circuit 41 is disable, and therefore the count value of the counter 39 holes the value N of the final address. Therefore, the level of the envelope signal $EV_1$ (or $EV_2$) is maintained at "0". Upon application of a single signal CCF (or CCV') again, the content of the counter 39 is cleared to zero, and count pulses are supplied to the counter 39. Thus, the percussive envelope signal $EV_1$ or $EV_2$ is provided in correspondence to the generation timing of the chord pyramid tone production instruction signals CCF (or CCV'), the musical tone is intermittently and repeatedly produced.

Figure 5:
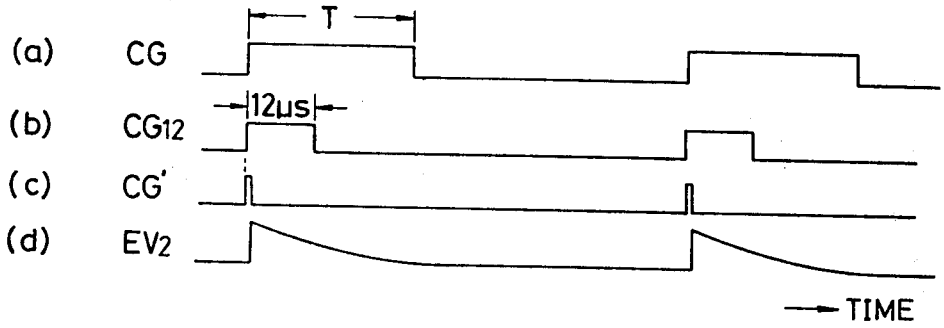
FIG. 5 is also a timing chart for a description of the generation of a percussive envelope waveform which is effected according to a chord tone production timing signal.

A chord tone production timing signal CG outputted by the automatic bass chord performance control device 14 is produced with a predetermined time width T at the timing at which s chord tone is to be produced as shown in the part (a) of FIG. 5. In this example, the envelope waveform is generated by application of a single tone production instruction signal at the beginning of a tone production. Accordingly, the chord tone production timing signal CG is applied to a differentiation and gate circuit 45 to obtain a differentiation pulse $CG_{12}$ having a 12-channel-time width (the part (b) of FIG. 5), and this differentiation pulse $CG_{12}$ is selected in synchronization with the channel times to which the lower keyboard tones (or the chord composing tones) are assigned, with the aid of a lower keyboard detecting signal LE provided by a lower keyboard detection decoder 46, thereby to obtain a single chord tone production instruction signal CG′ for every lower keyboard tone. The part (c) of FIG. 5 illustrates the signal CG′ as if it is produced only once whenever the signal CG rises. However, in practice, one signal CG′ is produced for each of the channel times to which lower keyboard tones (or chord composing tones) are assigned, that is, the signals CG′ are generated in a time division manner. This chord tone production instruction signal CG′ is applied through the OR circuit 25 to the envelope generator 24 to clear the envelope counter (39), as a result of which the percussive envelope signals $EV_2$ are generated (in a time division manner respectively for the channel times to which the lower keyboard tones are assigned) as shown in the part (d) of FIG. 5.

The lower keyboard detection decoder 46 receives the keyboard code $K_1$, $K_2$ out of the key codes KC outputted by the channel processor 13 to detect the lower keyboard code "1 0", and to produce the signal LE in synchronization with the channel time to which the lower keyboard tone is assigned, because automatic chord tones are produced as lower keyboard tones. The chord tone production timing signal CG is provided in a direct current mode irrespective of the tone production channels, and therefore the lower keyboard detecting signal LE is utilized for time-division of the signals CG:

In the operation of the automatic bass chord performance control device 14, an automatic chord is produced by the second musical tone forming system 16 according to the chord tone production timing signal CG. In this case, a chord pyramid tone is produced by the first musical tone forming system 15 according to the chord pyramid tone production instruction signal CCF. IN this operation, the automatic bass chord performance control device 14 will cooperated with the chord pyramid performance control device 17 so that the other signal CCV is not provided; however, the detailed description of this cooperation will not especially be made. In the case where only the chord pyramid performance control device 17 is operated without operating the automatic bass chord performance control device 14, both of the signals CCF and CCV are provided, and therefore chord pyramid tones are produced in both of the musical tone forming systems 15 and 16. Of course, the automatic bass tones are assigned to channels different from those to which lower keyboard tones are assigned, and therefore the automatic bass tones can be produced in both of the musical tone forming systems 15 and 16.

By operating the chord pyramid control device 17 while performing "the single finger function" in the automatic bass chord performance control device 14, the effects proposed by this invention are realized. Hereinafter, detailed examples of the automatic bass chord performance control device 14 and the chord pyramid performance control device 17 will be described with respect to the aforementioned effects only.

First of all, a method of illustrating various elements employed in the circuits shown in FIG. 7 and so forth will be described.

Figure 6:
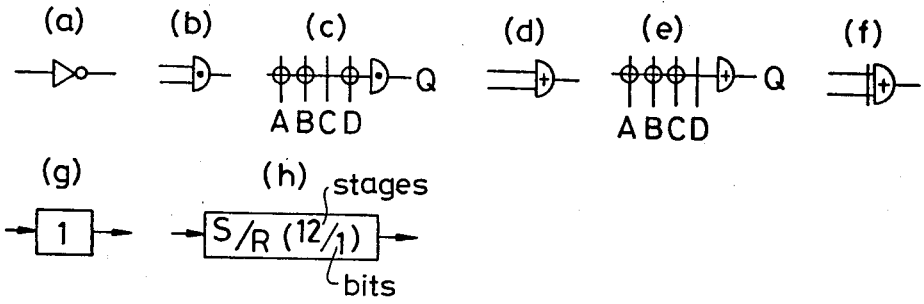
FIG. 6 is a diagram for a description of various methods of indicating various circuit elements.

The parts (a), (b) and (c), (d) and (e), (f) and (g) of FIG. 6 indicate an inverter, AND circuits, OR circuits, an exclusive OR circuit, and a 1-bit delay flip-flop, respectively. When the numbers of inputs of an AND circuit and of an OR circuit are small, these circuits are illustrated according to illustration methods as shown in the parts (c) and (e), respectively. When the numbers of inputs of an AND circuit and of an OR circuit are relatively large, one input line is provided on the input side of each circuit, a plurality of signal lines are intersected with the single input line, and the intersections are encircled. Therefore, in the case the part (c) of FIG. 6, its logical equation is $Q=A\cdot B\cdot C$. In the case of the part (e) of FIG. 6, its logical equation is $Q=A+B+C$. The part (h) of FIG. 6 illustrates a shift register, and the numerator of a fraction parenthesized in the block indicates the number of stages in the shift register, while the denominator thereof indicates the number of bits of input data to the shift register. No shifting clock pulses are illustrated for the delay flip-flop and the shift register; however, it should be noted that the clock pulses employed for the automatic bass chord performance control device 14 are different from those employed for the chord pyramid performance control device 17. That is, the clock pulses employed in the automatic bass chord performance control device 14 (FIGS. 7 through 9) are equal in period to those employed in the key coder 12, while the clock pulses employed in the chord pyramid performance control device 17 are main clock pulses $\phi_1$ (having a period of one microsecond, for instance) adapted to control time-divisional tone production assignment.

Figure 7:
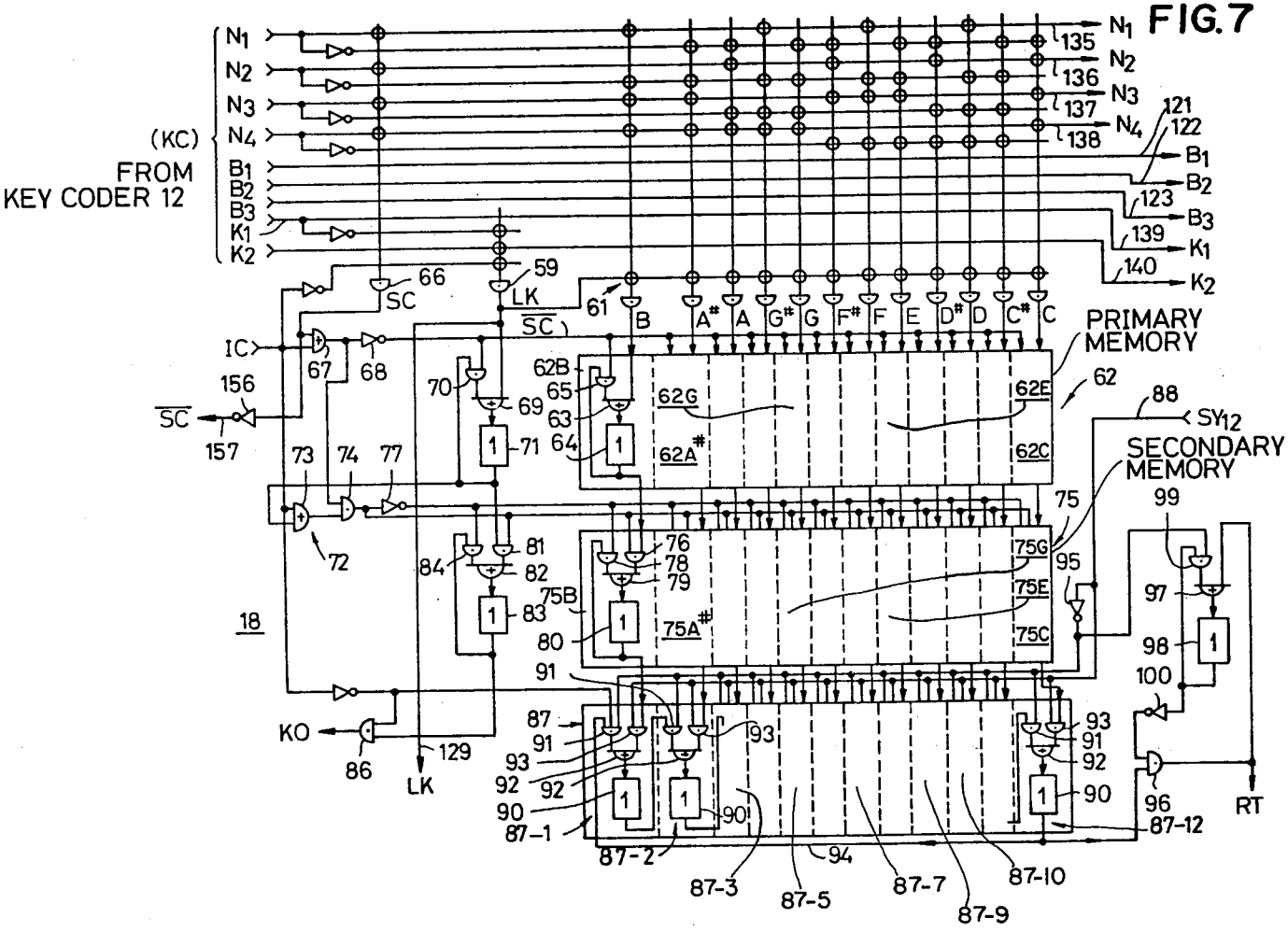
FIG. 7 to FIG. 9 are detailed circuit diagrams of the part of "single finger function" in an automatic bass chord performance control device shown in FIG. 1, FIG. 7 being a detailed circuit diagram of a chord detecting section, FIG. 8 being a detailed circuit diagram of a sub-tone forming data generating section, FIG. 9 being a detailed circuit diagram of a key code processing section.
Figure 8:
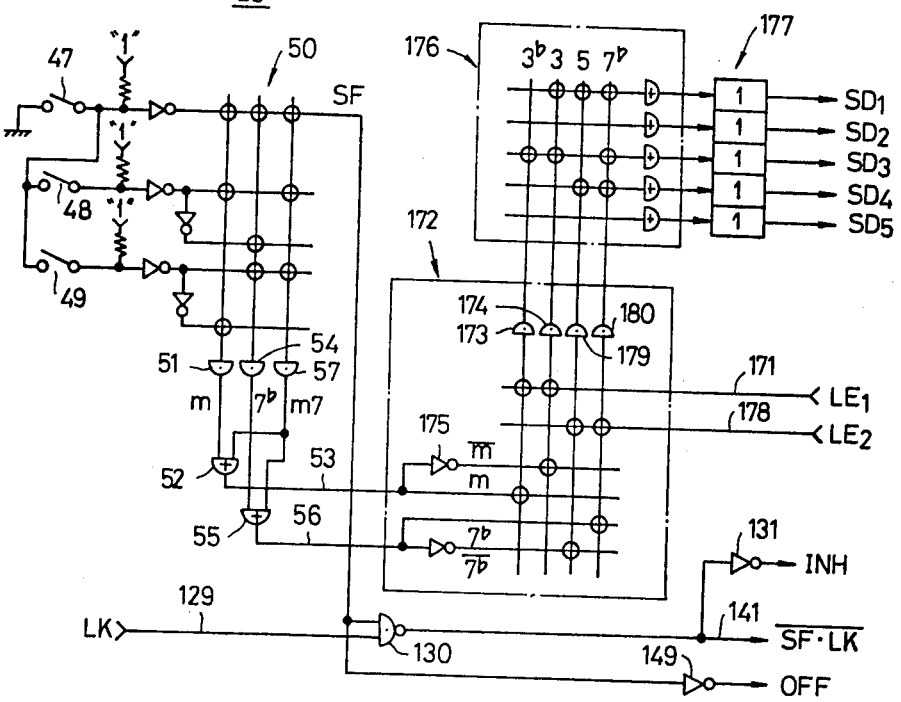
Figure 9:
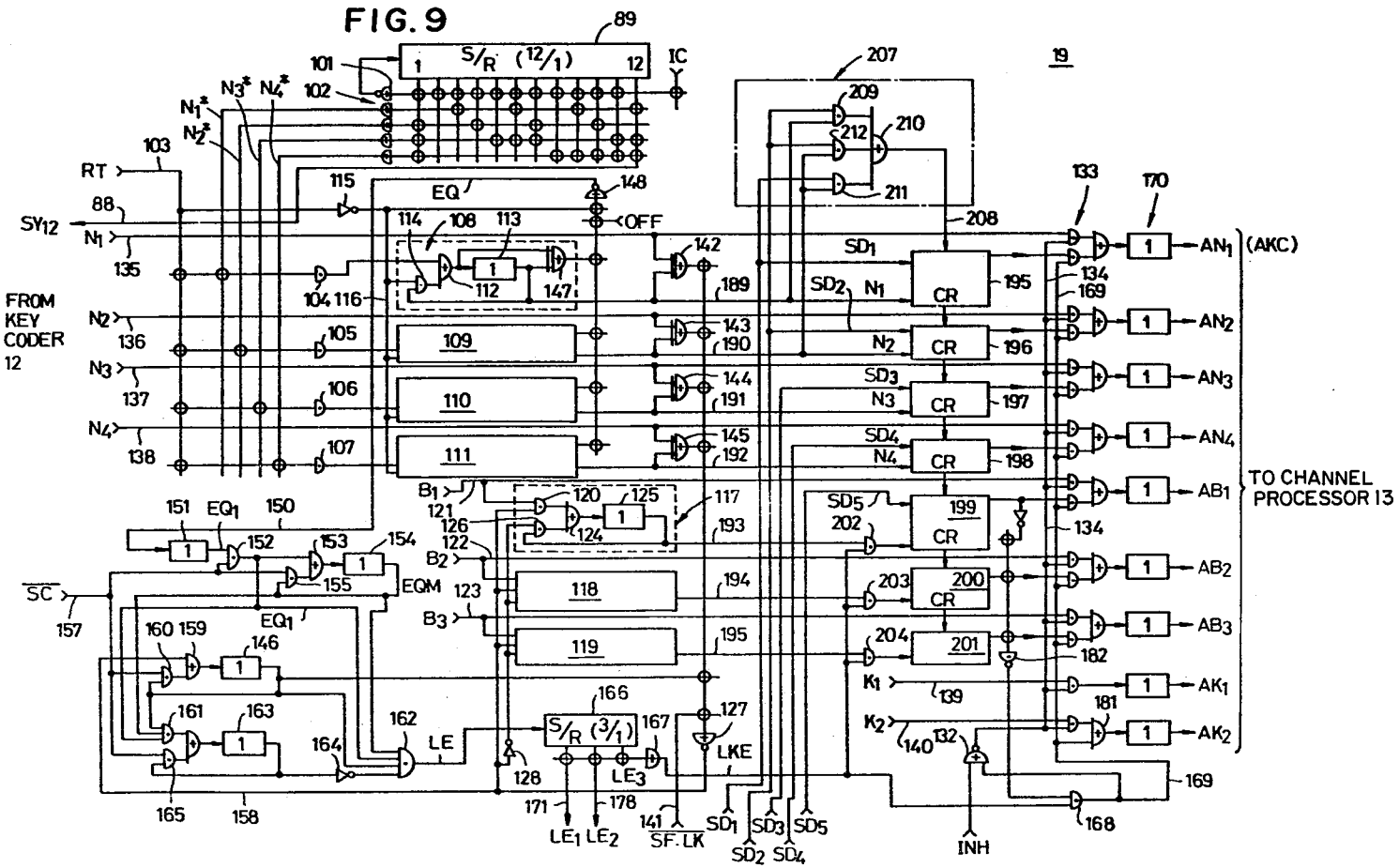

FIGS. 7 through 9 illustrate, in detail, parts of the automatic bass chord performance control device 14, which concern the single finger function only. The parts included in the chord detecting section 18 the sub-tone forming data generating section 20, and the key code processing section 19 are illustrated in FIGS. 7, 8 and 9, respectively.

In performing the automatic performance function according to this invention, a single finger function selecting switch 47 in FIG. 8 is turned on thereby to raise the level of a single finger function selecting signal SF to "1". In this manner, the circuits of FIGS. 7 through 9 are enabled, thereby to automatically form key codes AKC for a plurality of tones which are in predetermined interval relation to a single key depressed in the lower keyboard. This interval relation is established by the operation of chords selecting switches 48 and 49 in FIG. 8. The switch 48 is turned on when a "minor chord" is selected, while the switch 49 is turned on when a "seventh chord" is selected. Thus, four kinds of chord can be selectively obtained by combining the switches 47, 48 and 49, as indicated in Table 2 below:

TABLE 2

| | Switch | | 1 . . . . . switch on<br>0 . . . . . switch off |
|---|---|---|---|
| 47 | 48 | 49 | Kind of chord |
| 1 | 0 | 0 | Major |
| 1 | 1 | 0 | Minor (m) |
| 1 | 0 | 1 | Seventh (7♭) |

TABLE 2-continued

| Switch 47 | 48 | 49 | 1 . . . . . switch on<br>0 . . . . . switch off<br>Kind of chord |
|---|---|---|---|
| 1 | 1 | 1 | Minor seventh (m7) |

A decoder 50 provides signals m, 7♭ and m7 for specifying the kinds of chord according to the signals from the switches 47 through 49. To select the "major chord", only the switch 47 is turned on, and in this case the signals m, 7♭ and m7 are not provided. To select the "minor chord", both the switches 47 and 49 are turned on, so that the minor chord signal m is provided by an AND circuit 51 thereby to supply a signal "1" to a line 53 through an OR circuit 52. When the "seventh chord" is selected, both the switches 47 and 49 are switched on, so that the seventh chord signal 7♭ is provided by an AND circuit 54 thereby to supply a signal "1" to a line 56 through an OR circuit 55. When the "minor seventh chord" is selected, all of the switches 47, 48 and 49 are turned on, so that the minor seventh chord signal m7 is provided by an AND circuit 57, thereby to supply signals "1" to the lines 53 and 56 through the OR circuits 52 and 55, respectively.

In the case of the "major chord", three tones in interval relation of prime, major third, and perfect fifth are automatically formed. In the case of the "minor chord", three tones in interval relation of prime, minor third, and perfect fifth are formed; in the case of the "seventh chord", three tones in interval relation of prime, major third, and minor seventh; and in the case of the "minor seventh chord", three tones in interval relation of prime, minor third, and minor seventh.

Fundamental note detection

In FIG. 7, and AND circuit 59 operates to detect lower keyboard information according to the keyboard code $K_1$, $K_2$ out of the 9-bit key codes KC applied by the key coder 12. When the key code KC applied is for the lower keyboard, the output, or a lower keyboard detection signal LK, of the AND circuit 59 becomes "1", thereby to enable the AND circuits of a lower keyboard note decoder 61. This lower keyboard note decoder 61 receives the note code $N_1$- $N_4$ out of the key codes KC applied by the key coder 12 and decode it to one of the twelve notes C, C# . . . B. This decoding operation is carried out only when the note code $N_1$-$N_4$ is provided upon key depression in the lower keyboard. The twelve outputs for twelve notes C-B provided by the lower keyboard note decoder 61 are stored in the memory positions provided for the notes in a primary memory 62, respectively. In FIG. 7 only a memory position 62B for note B is illustrated in detail; however, other memory positions 62A# through 62C provided respectively for notes A# through C are similar in arrangement to the memory position 62B. In each of the memory positions 62B through 62C of the primary memory 62, a note detection signal applied by the note decoder 61 is applied through and OR circuit 63 to a delay flip-flop 64 and is self-held in the delay flip-flop 64 through an AND circuit 65. When a start code SC instead of the key code KC is applied by the key coder 12, and AND circuit 66 detects the fact that all of the bits of the note code $N_1$- $N_4$ become "1" thereby to output a signal "1" in correspondence to the start code SC. The start code detection SC from the AND circuit 66 is applied through an OR circuit 67, and an inverter 68 to the AND circuit 65 in each of the memory positions 62C through 62B, thereby to disable the AND circuit 65. The storage (self-held) in the primary memory 62 is cleared whenever the start code SC is provided. The initial clear signal IC applied to the OR circuit 67 and other relevant circuits becomes "1" temporarily only when application of the power supply is effected, thereby to inhibit the operations of the various circuits and to clear the storages. Normally, the initial clear signal IC is at the "0" level.

Figure 10:
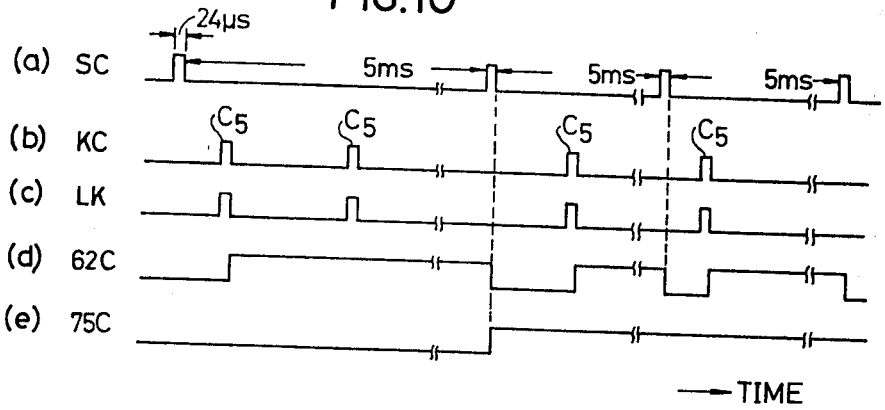
FIG. 10 is a timing chart for a description of one example of the operation of the circuit shown in FIG. 7.

For instance, it is assumed that only one key for note $C_5$ is depressed in the lower keyboard. The start code SC, as shown in the part (a) of FIG. 10, is provided substantially periodically. As for the key code KC, a code signal representative of a key (for note $C_5$ in the lower keyboard) depressed in supplied in a time division manner as shown in the part (b) of FIG. 10. Thus, the lower keyboard detection signal LK is provided by the AND circuit 59 in response to the key code of the lower keyboard, as shown in the part (c) of FIG. 10. In the lower keyboard note decoder 61, the note code for note C is decoded, and the signal "1" is stored in the memory position 62C for note C in the lower keyboard note primary memory 62, as a result of which a memory signal as shown in the part (d) of FIG. 10 is outputted.

The lower keyboard detection signal LK outputted by the AND circuit 59 is also stored in the delay flip-flop 71 through the OR circuit 69, and the AND circuit 70. Similarly as in the case of the lower keyboard primary memory 62, the storage in the delay flip-flop 71 is cleared whenever the start code SC is provided. However, when the output of the OR circuit 67 is "1" by the production of the start code SC, the output of the delay flip-flop 71 is "1". Therefore, the output of the OR circuit 73 in a memory control section 72 is "1", and the output of an AND circuit 74 becomes "1" with the generation timing of the start code SC. This output "1" of the AND circuit 74 operates to erase the old storage in the lower keyboard secondary memory 75 and to newly store the output of the primary memory 62 therein. The lower keyboard note secondary memory 75 comprises memory positions 75B through 75C provided respectively for notes B through C. Although only the memory position 75B is illustrated in detail, the other memory positions 75A# through 75C are similar in arrangement to the memory position 75B. By the output "1" of the aforementioned AND circuit 74, a reading AND circuit 76 is enabled, in each of the memory positions 75B through 75C. As a result, the signals stored in the memory positions 62B through 62C in the primary memory 62 are written in the respective memory positions 75B through 75C in the secondary memory 75. The output "1" of the AND circuit 74 is inverted by an inverter 77, whereby a holding AND circuit 78 in each of the memory positions 75B through 75C is disabled. As a result, the old memory in the secondary memory 75 is cleared, and a memory signal for each note in the primary memory 62 is newly stored in a delay flip-flop 80 through an OR circuit 79. When the start code SC disappears, the output of the AND circuit 74 becomes "0", and therefore the AND circuit in the secondary memory 75 is enabled, and the memory in the delay flip-flop 80 is self-held.

Accordingly, in the case of FIG. 10, the signal "1" is stored in the memory position 75C for note C in the lower keyboard note secondary memory with the timing of the start code SC. If as shown in the part (e) of FIG. 10, the signal "1" is stored in the memory position 75C in the secondary memory 75 once, the signal "1" is held in a direct current mode until the key is released, that is, until application of he key code KC for the note during one period of the start code is completely ceased. In other words, in the secondary memory 75, the signal "1" is stored in the memory position 75B, . . . , or 75C for the note of a key depressed in the lower keyboard at all times.

Similarly as in the above-described case, the memory signal in the delay flip-flop 71 which is the primary memory of the lower keyboard detection signal LK is stored in a delay flip-flop 83, which is a secondary memory, through an AND circuit 81 and an OR circuit 82 when the start code SC is provided. The lower keyboard detection signal LK stored in the delay flip-flop 83 is outputted in one bit time. In this case, the start code SC disappears. Therefore, the AND circuit 84 is enabled, and the memory in the delay flip-flop 83 is self-held. Thus, when a key in the lower keyboard (chord performance keyboard) is being depressed, the output of the flip-flop 83 is "1" in a direct current mode, and is utilized as a lower keyboard key depression signal KO through an AND circuit 86.

In the lower keyboard note secondary memory 75, a key depression memory signal "1" is outputted by a memory position (75C in the case of FIG. 10) for a note corresponding to a key depressed in the lower keyboard, and the outputs from the other memory positions are "0". The memory outputs of the notes in the secondary memory 75 are written, in a parallel mode, in twelve memory stages in a scanning circuit 87. A load pulse $SY_{12}$ having a 1-bit time width is applied to a writing control line 88 of the scanning circuit 87 by a shift register 89 (FIG. 9) every twelve bit times.

In the scanning circuit 87, a first memory stage 87-1, a second memory stage 87-2, and a last or twelfth memory stage 87-12 are illustrated in detail; however, it should be noted that the remaining third through eleventh memory stages 87-3 through 87-11 are similar in arrangement to the memory stages illustrated in detail. The scanning circuit is so designed that the output of a memory circuit in a memory stage, or the output of a delay flip-flop 90 in a memory stage, is stored in a delay flip-flop 90 in the succeeding memory stage through a data circulating AND circuit 91 and an OR circuit 92 of that succeeding memory stage, and that the output of a delay flip-flop 90 of the last memory stage 87-12 is applied through a circulation line 94 to a data circulating AND circuit 91 of the first memory stage 87-1. Furthermore, a memory output for each note in the lower keyboard secondary memory 75 is applied to a data writing AND circuit 93 in each memory stage. That is, the scanning circuit 87 is a circulating shift register of parallel input and series shift type. The shift clock pulse is one having a period of 24 microseconds to drive the delay flip-flop 90.

In each stage of the scanning circuit 87, the data writing AND circuit 93 is enabled when the load pulse $SY_{12}$ on the writing control line 88 is "1", and the data circulating AND circuit 91 is enabled by the output "1" of an inverter 95 when the load pulse $SY_{12}$ is "0". The number of memory stages in the scanning circuit 87 is twelve (12), and accordingly, it takes 12 bit times ($24 \times 12 = 288$ microseconds) for one circulation of data. Since the load pulse $SY_{12}$ is provided every 12 bit times, one circulation (scanning) is completed in the scanning circuit 87 whenever the load pulse is provided.

The scanning circuit 87 operates to scan the data of notes C through B stored in the memory positions 75C through 75B in the lower keyboard note secondary memory 75. The following Table 3 is to indicate the scanning conditions of note data in the scanning circuit 87.

TABLE 3

| | | Memory Stages in Scanning Circuit 87 | | | | | | | | | | | |
|---|---|---|---|---|---|---|---|---|---|---|---|---|---|
| Bit time | | 1 | 2 | 3 | 4 | 5 | 6 | 7 | 8 | 9 | 10 | 11 | 12 |
| ↓ | 1 | B | A# | A | G# | G | F# | F | E | D# | D | C# | C |
| ↓ | 2 | C | B | A# | A | G# | G | F# | F | E | D# | D | C# |
| ↓ | 3 | C# | C | B | A# | A | G# | G | F# | F | E | D# | D |
| ↓ | 4 | D | C# | C | B | A# | | . . . | | . . . . | | . . . . | D# |
| ↓ | 5 | | . . . . . | | C | B | A# | . . . | | . . . . | | . . . . | E |
| ↓ | 6 | | | . . . . . | | C | B | A# | | | . . . . . | | F |
| ↓ | 7 | | | | . . . . . | | C | B | A# | | | . . . . . | F# |
| Time | | | | | | | | | | | | | |
| | 8 | | | | | . . . . . | | C | B | A# | | | G |
| | 9 | | | | | | . . . . . | | C | B | A# | | G# |
| | 10 | | | | | | | . . . . . | | C | B | A# | A |
| | 11 | | | | | | | | . . . . . | | C | B | A# |
| $SY_{12}$ → | 12 | A# | A | G# | G | F# | F | E | D# | D | C# | C | B |

As indicated in Table 3, one bit time after the generation of the load pulse $SY_{12}$ the data of the highest note B is held in the first stage 87-1, and in the order of tone pitches the data of notes A#, A . . . C# are held respectively in the stages 87-2 through 87-11, and the data of the lowest note tC C is held in the last stage 87-12. Thereafter, for every one bit time, the data on the higher tone side are successively shifted toward the lower tone side. After 12 bit times, the data of the highest note B is held in the last stage 87-12, and the data of note A# through C are held in the first through eleventh stages 87-1 through 87-11 respectively in the order of tone pitches. Out of the data of notes C through B circulating in the scanning circuit 87, data concerning notes whose key depression memories have been effected in the secondary memory 75 have signals "1", and the remaining ones have signals "0".

Thus, the note whose data is held in the last stage 87-12 in the scanning circuit 87 is detected as the fundamental note (prime). That is, the output of the scanning circuit last stage 87-12 corresponding to the prime is applied to the AND circuit 96, and is stored in a delay flip-flop 98 through the AND circuit 96 and an OR circuit 97. The memory in the delay flip-flop 98 is self-held through an AND circuit 99. During one scanning period (12 bit times) the signal "1" firstly outputted by the scanning circuit stage 87-12 is stored in the delay flip-flop 98 through the AND circuit 96, and if this signal is stored once, the output of an inverter 100 becomes "0", and therefore the AND circuit 96 is disabled. If the load pulse $SY_{12}$ becomes "1" at the beginning of the scanning period, the AND circuit 99 is disabled through the inverter 95, and the delay flip-flop 98 is cleared. As for the note data stored in the scanning circuit last stage 87-12, the lower note appears first as C→C#→D . . . A#→B. Therefore, in response to the timing of the lowest note out of the notes of keys depressed in the lower keyboard, an output "1" is provided by the AND circuit 96.

This output "1" of the AND circuit 96 is employed as a fundamental note detection signal RT representative of the fundamental note. In the "single finger function", only one key is, in general, depressed in the lower keyboard. However, even if a plurality of keys are depressed, one key for the lowest tone out of the plurality of keys is selected as was described above.

The note of a root represented by the fundamental note detection signal RT is discriminated from the generation timing of the signal RT.

Figure 11:
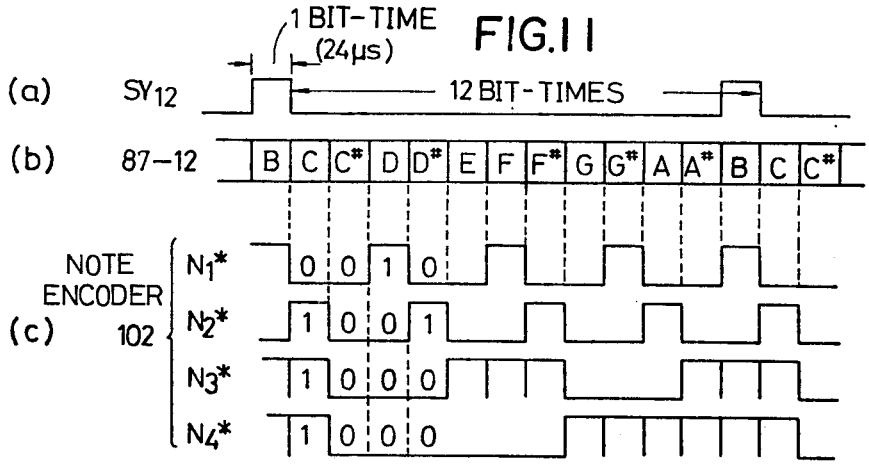
FIG. 11 is also a timing chart illustrating the fact that the status of scanning the note data in a scanning circuit shown in FIG. 7 is in synchronization with the generation of note codes $N_1$*–$N_4$* effected in a time division manner in a note encoder shown in FIG. 9.

If the note of the data held in the scanning circuit 87-12 corresponding to the fundamental note is indicated by the relation to the load pulse $ST_{12}$, it is as indicated in the parts (a) and (b) of FIG. 11. Whenever it passes one bit time from the generating timing of the load pulse $SY_{12}$, the fundamental note is successively shifted toward the higher tone side from the lower tone side in the order of tones C, C#, D . . . B. Accordingly, the fundamental note can be determined from how many bit times the generation timing of the fundamental note detection signal RT is later than the generating time of the load pulse $SY_{12}$.

The shift register (FIG. 9) for generating the load pulse $SY_{12}$ is to shift a single signal "1" in synchronization with the scanning operation of the scanning circuit 87. When the signal "1" arrives to the twelfth stage of the shift register 89, the load pulse $SY_{12}$ is supplied through a line 88. In this operation, all of the first through eleventh stages are at "0" level, the output of an NOR circuit 101 (FIG. 9) is raised to "1", and the signal "1" is inputted into the shift register 89. At the one bit time after the generation of the load pulse $SY_{12}$, the signal "1" is held in the first stage of the shift register 89, and accordingly a note encoder 102 consisting of four OR circuits output a note data $N_1$*-$N_4$*, or "1110" representing note C. At the next bit time, the signal "1" is shifted to the second stage of the shift register 89, and the note encoder 102 outputs the note code data $N_1$*-$N_4$* or "0000" representing note C#. Thus, whenever the bit time is advanced, the note code is provided starting from the note on the lower tone side in such a manner as D, D# . . . B. The part (c) of FIG. 11 shows the generation timing of the note codes $N_1$*-$N_4$* corresponding to the notes from the note encoder 102, and the timing of the notes is formed in a time division manner.

The operation of the note encoder 102 is in synchronization with the scanning operation in the scanning circuit 87, and the note of the note code which is outputted by the note encoder 102 with the same timing as the generation timing of the fundamental note detection signal RT coincides with the fundamental note which has provided the signal RT.

Memory of key Code of Fundamental Note

The fundamental note detection signal RT provided by the AND circuit 96 in FIG. 7 is supplied through a line 103 to AND circuits 104, 105, 106 and 107 in FIG. 9. The least significant bit data $N_1$* of each note code provided in a time division manner by the note encoder 102 as shown in the part (c) of FIG. 11 is applied to the AND circuit 104, the data $N_2$* to the AND circuit 105, the data $N_3$* to the AND circuit 106, and the data $N_4$* to the AND circuit 107. Therefore, according to the generation timing of the fundamental note detection signal RT the note code data $N_1$*-$N_4$* corresponding to the fundamental note are selected by the AND circuits 104 through 107, and are stored in note code memories 108, 109, 110 and 111, respectively. Only the note code memory 108 is illustrated in detail; however, the other note code memories 109, 110 and 111 are equal in construction to the note code memory 108. The note code data $N_1$*-$N_4$* applied through the respective AND circuits 104 through 107 are stored in respective delay flip-flops 113 through respective OR circuits 112, and the storages are self-held through respective AND circuits 114. When the fundamental note detection signal RT becomes "1" therefore inputting data are applied from the AND circuits 104 through 107, a signal "0" is supplied through the line 103 and an inverter 105 to a self-holding clear line 116 to disable the self-holding AND circuit 114 thereby to rewrite the storages in the memories 108 through 111.

The octave code data $B_1$ through $B_3$ of the fundamental note are stored in octave code memories 117, 118 and 119, respectively. Only the octave code memory 117 is illustrated in detail; however, the other octave code memories 118 and 119 are equal in construction to the octave code memory 117. The bit data $B_1$, $B_2$ and $B_3$ of the octave code are applied through lines 121, 122 and 123 to data writing AND circuits 120 in the octave code memories 117, 118 and 119, respectively. In the memories 117 through 119, the data $B_1$, $B_2$ and $B_3$ provided by the data writing AND circuits 120 are stored in delay flip-flops 125 through OR circuits 124, and the storages thereof are self-held through self-holding AND circuits 126, respectively. The data writing AND circuits 120 are enabled by the output "1" of a NOR circuit 127. When the AND circuits 120 are enabled, the self-holding AND circuits 126 are disabled through an inverter 128, thereby to rewrite the storages in the memories 117 through 119.

With respect to the octave code $B_1$, $B_2$, $B_3$ that of contents corresponding to a key depressed in the lower keyboard is stored in the following manner:

When a key code $N_1$-$K_2$ concerning the lower keyboard is supplied by the key coder 12 upon key depression in the lower keyboard, the lower keyboard detection signal LK is provided by the AND circuit 59 (FIG. 7). This lower keyboard detection signal LK is applied through a line 129 to a NAND circuit 130 in FIG. 8. The single finger function selection signal SF has been applied to the other input of the NAND circuit 130, and therefore when the lower keyboard key code $N_1$-$K_2$ is supplied in the single finger function, the output signal $\overline{SF \cdot LK}$ becomes "0".

This signal $\overline{SF \cdot LK}$ is inverted by an inverter 131 to have "1", and is utilized as an active key data inhibiting signal INH. This signal INH is applied to a NOR circuit 132 in FIG. 9, as a result of which the level of an active data selectable line 134 in a key data selection gate section 133 is lowered to "0" thereby to inhibit the key code $N_1$-$K_2$ of the key depressed in the lower keyboard which is supplied through lines 135 through 138, 121 through 123, 139 and 140 by the key coder 12.

The signal $\overline{SF \cdot LK}$ provided by the NAND circuit 130 is applied through a line 141 to a NOR circuit 127 in FIG. 9. Applied to the other input of the NOR circuit 127 are the output of EXCLUSIVE OR circuits 142 through 145 and the output of a delay flip-flop 146. In the EXCLUSIVE OR circuits, the note code data corresponding to the fundamental note stored in the note code memories 108 through 111 is compared with the not code data $N_1$-$N_4$ supplied through the lines 135 through 138 by the key coder 12, and when both data coincide with each other, all of the outputs become "0". The output of the delay flip-flop 146 is at "0" initially. Therefore, when the note code data of the fundamental note stored in the note code memories 108 through 111 coincides with the note code $N_1$-$N_4$ corresponding to the tone of the key depressed in the lower keyboard, the output of the NOR circuit 127 is raised to "1".

The output "1" of the NOR circuit 127 operates to enable the data writing AND circuits 120 in the octave code memories 117 through 119, and to allow the octave code $B_1$-$B_3$ supplied through the lines 121 through 123 by the key coder 12 to be stored in the memories 117 through 119. Thus, the note code and octave code data of the tone corresponding to the fundamental note are stored in the memories 108 through 111 and 117 through 119.

Chord Tone (Lower Keyboard Tone) Generation Instruction

In the note code memories 108 through 111 are provided EXCLUSIVE OR circuits 147 for detecting coincidence between the data previously stored therein and the data to be written therein next, respectively. The reason for this is that only when the same data is stored in the note code memories 108 through 111 successively at least twice, the data is utilized as the data of the tone corresponding to the true fundamental note.

In each of the note code memories 108 through 111, the preceding fundamental note data stored in the delay flip-flop 113 (the output of the flip-flop 113) and a new fundamental note data to be stored in the delay flip-flop 113 (the input of the flip-flop 113) are applied to the EXCLUSIVE OR circuit 147. In the case when the same note data is stored in the memories 108 through 111 successively twice, the input data of the delay flip-flop 113 is coincident with the output data of the same, and therefore all of the outputs of the EXCLUSIVE OR circuits 147 in the memories 108 through 111 become "0". These outputs "0" of the EXCLUSIVE OR circuits 147 in the memories 108 through 111 are applied to a NOR circuit 148 whereby a coincidence signal EQ is produced thereby. However, the operating conditions of this NOR circuit 148 are satisfied when the output of the above-described inverter 115 (the self-holding clear line 116) and a system off signal OFF are at "0". The condition that the system off signal OFF is at "0" means that the system is not placed in an off state, that is, the single finger function has been selected. The system off signal OFF is obtained by inverting the single finger function selection signal SF by an inverter 149 (FIG. 8). The condition that the output of the inverter 115 is at "0" means that the memories in the note code memories 108 through 111 are rewritten, that is, data to be newly stored which is subjected to coincidence detection in the EXCLUSIVE OR circuit 147 has been supplied.

Thus, when all of the inputs to the NOR circuit 148 became "0", the output "1" is applied, as the coincidence signal EQ, to the line 150 and to a delay flip-flop 151. In the delay flip-flop 151, the coincidence signal EQ is delayed by one bit time, is applied through an AND circuit 152 and an OR circuit 153 to a delay flip-flop 154 to be stored therein, and is self-held therein through an AND circuit 155. An inverted start code signal $\overline{SC}$ has been applied to the AND circuits 152 and 155. Accordingly, when when a start code SC (the part (a) of FIG. 12) is supplied from the key coder 12 every predetermined time instant, this start code SC is detected by the AND circuit 66 in FIG. 7, whereby the inverted start code signal $\overline{SC}$ at the "0" level is supplied through an inverter 156 and a line 157 to disable the AND circuits 152 and 155. Accordingly, upon application of the start code SC, the self-holding state of the delay flip-flop 154 is released.

Figure 12:
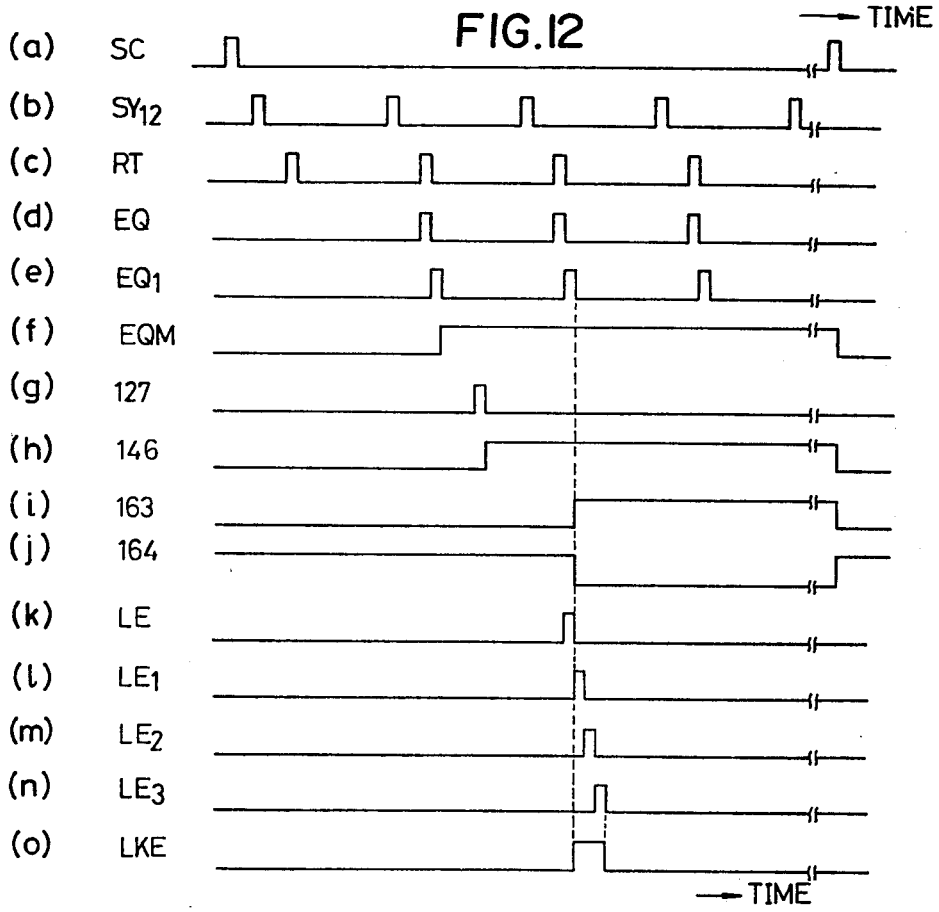
FIG. 12 is a timing chart indicating one example of the operation of the circuit shown in FIG. 9.

For instance, as shown in the part (c) of FIG. 12, one fundamental note detection signal RT is provided during one generation period of the load pulse $SY_{12}$ (the part (b) of FIG. 12), and this is repeated. In response to the generation of the signal RT, the coincidence signal EQ is generated (the part (d) in FIG. 12). The coincidence signal EQ is delayed by one bit time in the delay flip-flop 151, as a result of which a delayed coincidence signal $EQ_1$ is provided as indicated in the part (e) of FIG. 12. This delayed coincidence signal $EQ_1$ is stored in the delay flip-flop 154, and a memory coincidence signal EQM rises in one bit time as indicated in the part (f) of FIG. 12. The memory coincidence signal EQM is held until the next start code SC is applied.

As was described before, when the key depression key code data corresponding to the fundamental note is applied by the key coder 12, the NOR circuit 127 (FIG. 9) provides its output "1". This output "1" of the NOR circuit 127 is stored in a delay flip-flop 146 through a line 158 and an OR circuit 159. One bit time after this, the output of the delay flip-flop 146 is raised to "1", and therefore the operations of the NOR circuit 127 are not established. The memory in the delay flip-flop 146 is self-held through the AND circuit 160; however, if the inverted start code $\overline{SC}$ becomes "0" with the generation timing of the start code SC (the part (a) of FIG. 12), the AND circuit 160 is disabled, as a result of which the memory is cleared. The part (g) of FIG. 12 shows one example of the output of the NOR circuit 127, while the part (h) shows one example of the output of the delay flip-flop 146.

The output of the delay flip-flop 146 is applied to the AND circuit 161 and to the AND circuit 162. The delayed coincidence signal $EQ_1$ from the AND circuit 152 and the memory coincidence signal EQM stored in the delay flip-flop 154 are applied to both the AND circuits 161 and 162. When the conditions of the AND circuit 161 are satisfied, the signal "1" is stored in the delay flip-flop circuit 163 (cf. the part (i) of FIG. 12). A signal (the part (j) of FIG. 12) obtained by inverting the output of the delay flip-flop 163 by the inverter 164 is applied to the AND circuit 162. Therefore, when the conditions of the above-described AND circuit 161 are satisfied during one generation period of the start code SC, the conditions of the AND circuit 162 are satisfied, as a result of which a single chord tone generation instruction signal LE is provided as indicated in the part (k) of FIG. 12. If the signal "1" is stored in the delay flip-flop 163 once, this memory is not cleared until the self-holding AND circuit 165 is disabled with the generation timing of the start code SC. Therefore, the signal LE is produced only once during one generation period of the start code SC.

The chord tone generation instruction signal LE outputted by the AND circuit 162 is applied to a three-stage shift register 166, and is outputted, as chord tone data generation timing signals $LE_1$, $LE_2$ and $LE_3$ (cf.

the parts (l), (m) and (n) of FIG. 12) by the first, second and third stages thereof by being delayed successively by one bit time in each stage. The shift register 166 is provided for forming in a time division manner the key code data corresponding to the tones composing the chord tone. The timing signal $LE_1$ is to indicate the timing at which the key code data corresponding to the prime interval, that is, the fundamental note is formed while the timing signals $LE_2$ and $LE_3$ are to indicate the timing at which the key code data for the sub-tones are formed.

Processing of Key Code

The data representing the note and octave of the note corresponding to the fundamental note stored in the note code memories 108 through 111 and the octave code memories 117 through 119 are applied to adders 195, 196, 197, 198, 199, 200 and 201 respectively through lines 189, 190, 191, 192, 193, 194 and 195. The adders 195 through 199 are 1-bit full-adders, while the adders 200 and 201 are 1-bit half-adders. The carry signal CR of a first adder is applied to a second adder which is higher by one bit the first adder, and these adders form a 7-bit adder, as a whole. The signals on the output lines 193, 194 and 195 of the octave code memories 117, 118 and 119 are applied through AND circuits 202, 203 and 204 to the adders 199, 200 and 201, respectively.

In the adders 195 through 201, sub-tone forming data $SD_1$ through $SD_5$ are added to the key code data $N_1$-$B_3$ corresponding to the fundamental note supplied from the note code memories 108 through 110 and the octave code memories 117 through 119, thereby to form key code data corresponding to sub-tones. The least significant bit $SD_1$ of the sub-tone forming data is applied to the adder 195 corresponding to the least significant bit $N_1$ of the note code, and the higher bits $SD_2$, $SD_3$ and $SD_4$ is applied to the adders 196, 197 and 198 corresponding to the higher bits $N_2$, $N_3$, $N_4$ of the note code, respectively, and the most significant bit $SD_5$ is applied to the adder 109 corresponding to the least significant bit $B_1$ of the octave code.

The sub-tone forming data $SD_1$-$SD_5$ has a value corresponding to an interval which a sub-tone to be formed with this data $SD_1$-$SD_5$ has with respect to the fundamental note. The data $SD_1$-$SD_5$ is added to the lower bit-data $N_1$-$B_1$ corresponding to the fundamental note to form a key code data corresponding to the sub-tone. However, as is apparent from Table 1 provided before, the difference between the note codes of notes is not in direct correspondence to the interval between the notes, because while the data of the note code $N_1$-$N_4$ is of 4 bits and can have sixteen (16) different values ranging from "0000" to "1111", the number of notes in one octave is twelve (12). As is apparent from Table 1, four data "0011", "0111" and "111" in which the bits $N_1$ and $N_2$ are "1" are not employed in the note code $N_1$-$N_4$, and the remaining twelve different data are assigned to the twelve tones.

The number of chormatic intervals is twelve (12) in one octave. Therefore, if the value of the subtone forming data $SD_1$-$SD_4$ (with exception of the bit $SD_5$ corresponding to one octave interval) is set to be in correspondence to the value of the above-described note code $N_1$-$N_4$, it is convenient. Thus, without using four data "0011", "0111", "1011" and "1111" corresponding respectively to the numerals "3", "7", "11" and "15" in decimal notation, the remaining twelve (12) data are assigned as indicated in the following Table 4 in correspondence to the magnitude in interval:

TABLE 4

| Interval | Subtone forming data $SD_4$ | $SD_3$ | $SD_2$ | $SD_1$ | Decimal number |
|---|---|---|---|---|---|
| Prime (1) | 0 | 0 | 0 | 0 | 0 |
| Minor second (2♭) | 0 | 0 | 0 | 1 | 1 |
| Major second (2) | 0 | 0 | 1 | 0 | 2 |
| Minor third (3♭) | 0 | 1 | 0 | 0 | 4 |
| Major third (3) | 0 | 1 | 0 | 1 | 5 |
| Perfect fourth (4) | 0 | 1 | 1 | 0 | 6 |
| Diminished fifth (5♭) | 1 | 0 | 0 | 0 | 8 |
| Perfect fifth (5) | 1 | 0 | 0 | 1 | 9 |
| Minor sixth (6♭) | 1 | 0 | 1 | 0 | 10 |
| Major sixth (6) | 1 | 1 | 0 | 0 | 12 |
| Minor seventh (7♭) | 1 | 1 | 0 | 1 | 13 |
| Major seventh (7) | 1 | 1 | 1 | 0 | 14 |
| 1 octave | ($SD_5$) | | | | |
| (OCT | 10 | 0 | 0 | 0 | 16 |

Only the note codes $N_1$–$N_4$ are extracted and indicated in Table 5 again.

TABLE 5

| Group | | Note | $N_4$ | $N_3$ | $N_2$ | $N_1$ | Decimal number |
|---|---|---|---|---|---|---|---|
| | a | C# | 0 | 0 | 0 | 0 | 0 |
| I | b | D | 0 | 0 | 0 | 1 | 1 |
| | c | D# | 0 | 0 | 1 | 0 | 2 |
| | a | E | 0 | 1 | 0 | 0 | 4 |
| II | b | F | 0 | 1 | 0 | 1 | 5 |
| | c | F# | 0 | 1 | 0 | 0 | 6 |
| | a | G | 1 | 0 | 0 | 0 | 8 |
| III | b | G# | 1 | 0 | 0 | 1 | 9 |
| | c | A | 1 | 0 | 1 | 0 | 10 |
| | a | A# | 1 | 1 | 0 | 0 | 12 |
| IV | b | B | 1 | 1 | 0 | 1 | 13 |
| | c | C | 1 | 1 | 1 | 0 | 14 |

In Table 5, the notes can be assigned to four groups I, II, III and IV in such a manner that three tones having continuous values in data $N_1$–$N_4$ belong to one group. Furthermore, in each group the tones can be assigned to groups a, b and c in the order of increasing tone pitch.

It is assumed that the sub-tone forming data $SD_1$–$SD_4$ indicated in Table 4 are added to the note codes $N_1$–$N_4$ in Table 5. In this case, it can be found that the note codes $N_1$–$N_4$ of the tones (C#, E, G and A#) in the group a have values at which the note code data of predetermined sub-tones having predetermined intervals with respect to all of the sub-tone forming data $SD_1$–$SD_4$ can be obtained. Therefore, in the case where any one of the tones in the groups a in Table 5 is employed as a fundamental note, note code data $AN_1$–$AN_4$ corresponding to a desired sub-tone can be obtained simply by adding sub-tone forming data $SD_1$–$SD_4$ to the note code $N_1$–$N_4$ of the tone in a relevant group a supplied through the lines 189 through 192 by the note code memoires 108 through 111 in the adders 195 through 198.

Furthermore, in the case where a sub-tone forming data $SD_1$–$SD_4$ corresponding to an interval of major second, perfect fourth, minor sixth or major seventh is added to the note codes $N_1$–$N_4$ of a note (D, E, G# or B) in the group b, the result of this addition will have data (3, 7, 11 or 15 in decimal notation) which is not employed in the note codes $N_1$–$N_4$. In the addition of sub-tone forming data $SD_1$–$SD_4$ corresponding to intervals other than described above, predetermined note code data having predetermined intervals can be obtained. For instance, if the minor third interval data "4" is added to the value "1" corresponding to note D, the result of addition is "5", and therefore it is possible to obtain the note code data of note F having the minor third interval with respect to note D. However, if the major second interval data value "2" is added to the value "1", the result of addition is "3", which is not employed in the note codes $N_1$–$N_4$. Since a note having an interval of major second with respect to note D is note E, the result of addition should be the value "4". This can be obtained by adding "1" to the addition result "3".

Thus, in the case where a note in the group b is employed as a fundamental note, it is necessary to carry out data value correction as required when addition is carried out in the adders 195 through 198. This data value correction can be achieved by adding the value "1" to the adder 195 through a line 208 by means of a value correction circuit 207. More specifically, in the case where a sub-tone forming data $SD_1$–$SD_4$ corresponding to an interval of major second, perfect fourth, minor sixth or major seventh is merely added to the note code $N_1$–$N_4$ of a note in the groups b, the result of addition will have a value "3", "7", "11" or "15" which is not employed in the note codes $N_1$–$N_4$. However, by adding the value "1" for correction through the line 208, the result of addition described above is corrected to a value "4", "8", "12" or "0 (16)", thereby providing a correct note code data having an interval of major second, perfect fourth, minor sixth or major seventh with respect to the fundamental note.

As is apparent from Table 5, in each of the notes in the groups b the least significant bit data $N_1$ thereof is a logical value "1". Therefore, a signal on the output line 189 of the note code memory 108 corresponding to the bit $N_1$ is applied to an AND circuit 209 in the value correction circuit 207, and when the fundamental note belongs to the group b, the AND circuit 209 is enabled. Furthermore, as indicated in Table, as in the sub-tone forming data having intervals of major second, perfect fourth, minor sixth and major seventh the data $SD_2$ at the second bit from the least significant bit is a logical value "1", this data $SD_2$ is applied to the other input of the AND circuit 209. In this case, if the operating conditions of the AND circuit 209 are satisfied, a signal "1" is outputted, and therefore the value "1" for value correction is applied to the adder 195 through an OR circuit and the line 208.

In the case where a sub-tone forming data $SD_1$–$SD_4$ corresponding to an interval of minor second, major third, perfect fifth or minor seventh indicated in Table 4 is added to the note code $N_1$–$N_4$ of a note (D#, F#, A or C) in the group c in Table 5, the result of addition will have data ("3", "7", "11" or "15" in decimal notation) which is not employed in the note codes $N_1$–$N_4$. Furthermore, if a sub-tone forming data $SD_1$–$SD_4$ corresponding to an interval of major second, perfect fourth, minor sixth or major seventh indicated in Table 4 is added to the note code $N_1$–$N_4$ of a note in the group c in Table 5, the addition will result in a tone lower by a halftone than a tone which is originally in above-described relation (major second, perfect fourth, and so fourth). Therefore, similarly as in the case of the notes in the group b, the value "1" is added to the adder 195 through the line 208 by the value correction circuit 207 for value correction. However, it should be noted that it is unnecessary to carry out value correction with respect to the sub-tone forming data of intervals (prime, minor third, diminished fifth and major sixth) other than described above.

As indicated in Table 5, the data $N_2$ at the second bit from the least significant bit in the note code for each note in the group c is a logical value "1". Therefore, a signal on the output line 190 of the note code memory 109 is applied to AND circuits 211 and 212 in the value correction circuit 207, and when the note in the group c is the fundamental note, these AND circuits 211 and 212 are enabled. Furthermore, as indicated in Table 5, the least significant bit $SD_1$ of a sub-tone forming data corresponding to an interval of minor second, major third, perfect fifth or minor seventh has a logical value "1". Thus, the least significant bit data $SD_1$ of the sub-tone forming data is applied to the AND circuit 211, while the second bit data $SD_2$ is applied to the AND circuit 212. As a result, when the operating conditions of the AND circuit 211 or 212 are satisfied, the signal "1" is applied to the line 208 through the OR circuit 210, and therefore the value "1" for value correction is added to the adder 195.

It is assumed that when the fundamental note is note D for instance, a sub-tone forming data $SD_1$–$SD_4$ corresponding to an interval of major third is provided. In this case, both the data $N_2$ on the line 190 and the data $SD_1$ are at "1", and therefore the operating conditions of the AND circuit 211 are satisfied, and the signal "1" is supplied through the line 208. In this case, the addition in the adders 195 through 198 can be expressed as "2+5+1=8" in decimal notation; that is, the note code data of note G higher by major third interval than note D# is obtained as a result of the addition.

When the result of addition in the adders 195 through 198 corresponding to the note code $N_1$–$N_4$ exceeds the value "16" in decimal notation, a carry signal CR is provided by the adder 198 and is applied to an adder 199 corresponding to one octave interval. In adders 199 through 201 for octave code processing, the sub-tone forming data $SD_5$ (indicated in the bottom of Table 4) corresponding to the cary signal CR from the adder 198 and one octave interval is added to the octave code $B_{1-B3}$ of a tone corresponding to the fundamental note stored in the octave code memories 117 through 119.

The outputs $LE_1$, $LE_2$ and $LE_3$ of the stages of a shift register 166 are applied to an OR circuit 167, the output LKE (the part (o) of FIG. 12) of which is applied to AND circuits 168, 202, 203 and 204. Accordingly, in response to the chord tone data generation timing signal LKE ($LE_1$–$LE_3$), the AND circuits 202 through 204 are enabled, and the octave code $B_1$–$B_3$ stored in the octave code memories 117 through 119 is supplied to the adders 199 through 201. In addition, in response to the chord tone data generation timing signal LKE ($LE_1$–$LE_3$) the output of an AND gate 168 is raised to "1", while the processed data selectable line 169 of a key data selecting gate section 133 has the signal "1", as a result of which the outputs of the adders 195 through 201 are selected by the gate section 133.

When the fundamental note data generating timing signal $LE_1$ is outputted by the shift register 166, the fundamental note's note code data and the octave code data stored respectively in the note code memories 108 through 111 and the octave code memories 117 through 119 are applied to the adders 195 through 201. In this operation, all of the sub-tone forming data $SD_1$–$SD_5$ are at "0", and the adders 195 through 201 output the key code data corresponding to the fundamental note from the memories 108 through 111 and 117 through 119 as they are, and apply them to the channel processor 13 through the selecting gate section 133 and a delay flip-flop group 170.

The signal $LE_1$ provided by the first stage of the shift register 166 is applied through a line 171 to a chord system sub-tone selecting gate section 172 in FIG. 8 to enable AND circuits 173 and 174 therein. As was described before, in the case of the single finger function, a kind of chord is specified by the minor chord signal m or the seventh chord signal 7♭ which is supplied through the line 53 or the line 56 by the decoder 50. The minor chord signal m on the line 53 is applied to the AND gate 173 in the chord system sub-tone selecting gate section 172, and a signal $\overline{m}$ obtained by inverting it by an inverter 175 is applied to the AND gate 174. Accordingly, in the case where a minor chord has been selected, the AND circuit operates with the timing of the signal $LE_1$ to apply a minor third interval selection signal 3♭ to an interval value memory 176. On the other hand, in the case where no minor chord has been selected, the AND circuit 174 operates with the timing of the signal $LE_1$ thereby to apply a major third interval selection signal 3 to the interval value memory 176.

In response to the interval selection signal 3♭ or 3, the interval value memory 176 operates to output the sub-tone forming data $SD_5$–$SD_1$ having the value "00100" corresponding to the minor third interval or the value "00101" corresponding to the major third interval. After being delayed by one bit time by a delay flip-flop group 177, the data $SD_5$–$SD_1$ are applied to the adders 195 through 199 in synchronization with the timing at which the sub-tone data generation timing signal $LE_2$ is provided by the second stage in the shift register 166 in FIG. 9. Thus, with the generation timing of the signal $LE_2$, the sub-tone forming data $SD_1$–$SD_5$ for the minor third or major third is added to the key code data of the fundamental tone, as a result of which sub-tone key code data $AN_1$–$AB_3$ having an interval of minor third or major third with respect to the fundamental note are formed. The outputs of the adders 195 through 201 are selected by the selecting gate section 133 with the timing of the signal $LE_2$, and are applied to the channel processor 13.

The output signal $LE_2$ of the second stage in the shift register 166 is applied through the line 178 to the chord system sub-tone selecting gate section 172 in FIG. 8 to enable AND gates 179 and 180. In the case where a seventh chord has been selected, when the seventh chord signal 7♭ on the line 56 is raised to "1", the AND circuit 180 is operated, and therefore a minor seventh interval selection signal 7 is applied to the interval value memory 176. On the other hand, in the case where the seventh chord signal is at "0", its inverted signal $\overline{7♭}$ is raised to "1". As a result, the AND circuit 179 is operated, so that a perfect fifth interval selection signal 5 is applied to the interval value memory 176.

In response to the interval selection signal 5 or 7♭, the sub-tone forming data $SD_5$–$SD_1$ having a value "01001" corresponding to the perfect fifth interval or a value "01101" corresponding to the minor seventh interval is outputted by the interval value memory 176. The output of the memory 176 is delayed by one bit time by the delay flip-flop group 177, and is applied to the adders 195 through 199 in synchronization with the timing at which the sub-tone data generation timing signal $LE_3$ is provided by the third stage in the shift register 166. Therefore, the key code data $AN_1$–$AB_3$ of a sub-tone having an interval of perfect fifth or minor seventh is provided in synchronization with the signal $LE_3$.

In addition, when the processed data selectable line 169 has the signal 1 in response to the chord tone data generation timing signal LKE, the output of the OR circuit in the key data selecting gate 133 is raised to "1", and the data $AK_2$ has "1". In this case, as the data $AK_1$ is at "0", the keyboard code data $AK_2$, $AK_1$ becomes "1, 0", whereby the lower keyboard code is formed. Thus, the key code data $AN_1$–$AK_2$ of the lower keyboard, or the chord tone, is formed.

The output of a NAND circuit 182 is applied to the other input of the AND circuit 168 to which the chord tone data generation timing signal LKE is applied. The upper limit value of the octave code $B_3$–$B_1$ is "1 0 1" as indicated in Table 1; however, the output of the adders 201, 200 and 199 may have "1 1 0" through addition. When the value of the octave code exceeds the upper limit value, no tone is formed by the musical tone forming systems 15 and 16, or a click sound may be formed. However, it is useless to assign one tone production channel to such a sound. Accordingly, the inverted output of the adder 199 and the outputs of the adders 200 and 201 are applied to the ANAND circuit 182, when these outputs are of "1 1 0", the NAND circuit 182 provides an output signal "0" to disable the AND circuit 168. Thus, supplying the processed key code $AN_1$–$AK_2$ to the channel processor 13 is prohibited.

As is apparent from the description, the three kinds of key codes AKC provided in response to the chord tone data generation timing signals $LE_1$–$LE_3$ are generated respectively once in one period of the start code SC and are applied to the channel processor 13. As was described above, if a key code KC is supplied to the channel processor 13 even once in one period of the start code SC, the channel processor will decide that the key pertaining to the key code has been depressed (or tone production assignment should be continued). As the timing signals $LE_1$ through $LE_3$ are repeatedly produced with the same period as that of the start code SC, the tone production of the key represented by a key code AKC formed according to the signals $LE_1$ through $LE_3$ is continuously assigned to an appropriate tone production channel. When one key corresponding to the fundamental note which has been depressed in the lower keyboard of the keyboard 11 is released, the memory in the lower keyboard note secondary memory 75 (FIG. 7) is cleared, and therefore no fundamental note detection signal RT is produced. Therefore, no chord tone data generation timing signals $LE_1$ through $LE_3$ are produced, and the tone production assignment of the three kinds of key code AKC is cancelled.

Chord Pyramid Performance

The key codes AKC of three tones in predetermined interval relation formed by the automatic bass chord performance control device 14 are assigned to suitable channels by the channel processor 13, and are outputted in synchronization with the their assigned channel times (cf. the part (b) of FIG. 2) in a time division manner. In addition, according to this tone production assignment the attack start signal AS or the decay start signal DS is also outputted in a time division manner. The musical tone forming systems 15 and 16 operate to provide the musical tone signals of the aforementioned three tones in accordance with the key code KC supplied by the channel processor 13. In the second musical tone forming system 16, the above-described three tones are simultaneously but intermittently produced with the timing of the chord tone production timing signal CG, thereby to provide an effect of chopping a chord. In the first musical tone forming system 15, the aforementioned three tones are successively, or one at a time, at predetermined time intervals in accordance with the chord pyramid tone production instruction signal CCF supplied by the chord pyramid performance control device 17.

Figure 13:
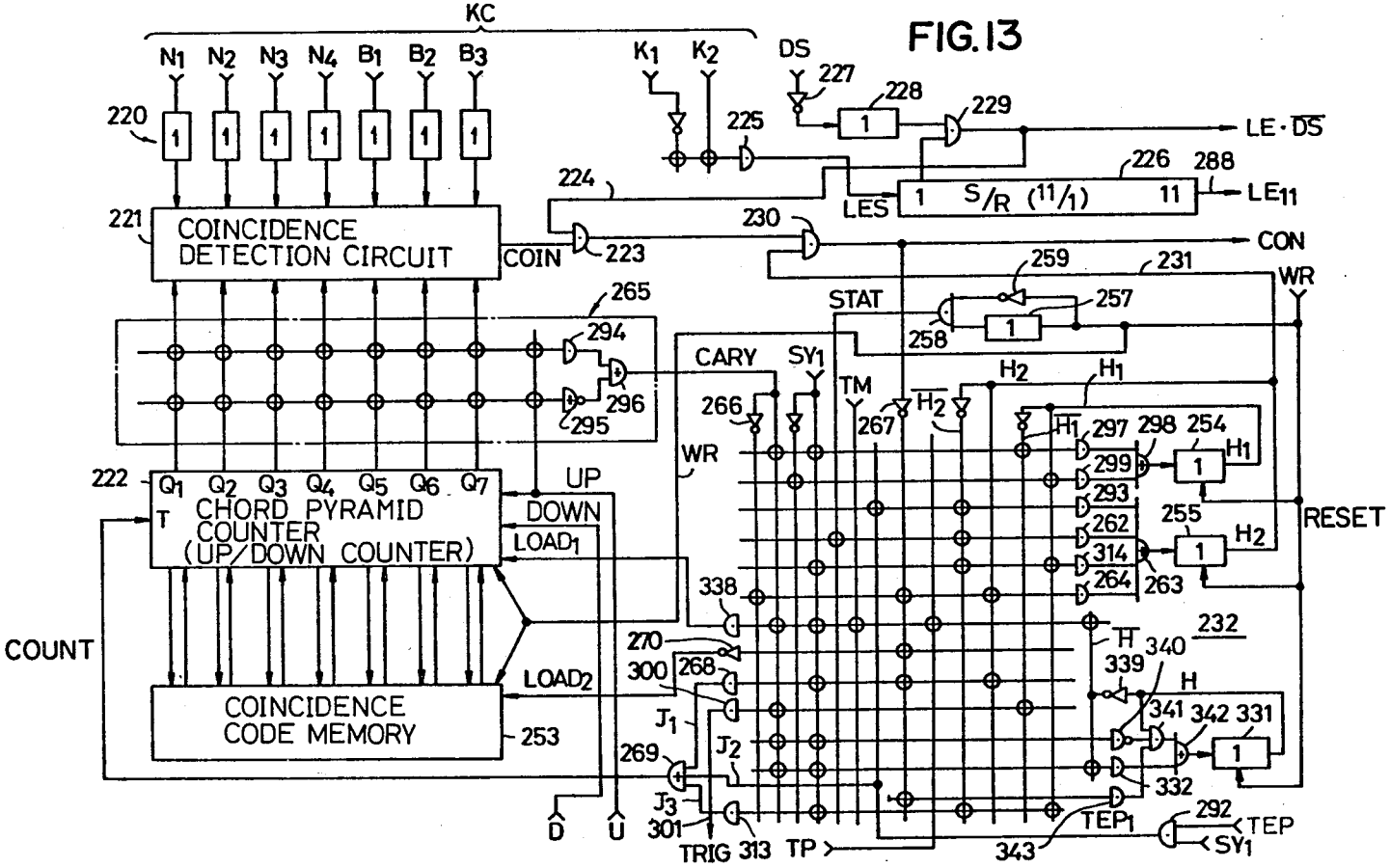
FIG. 13 through FIG. 15 are three parts of a detailed circuit diagram illustrating one example of the chord pyramid performance control device shown in FIG. 1.
Figure 14:
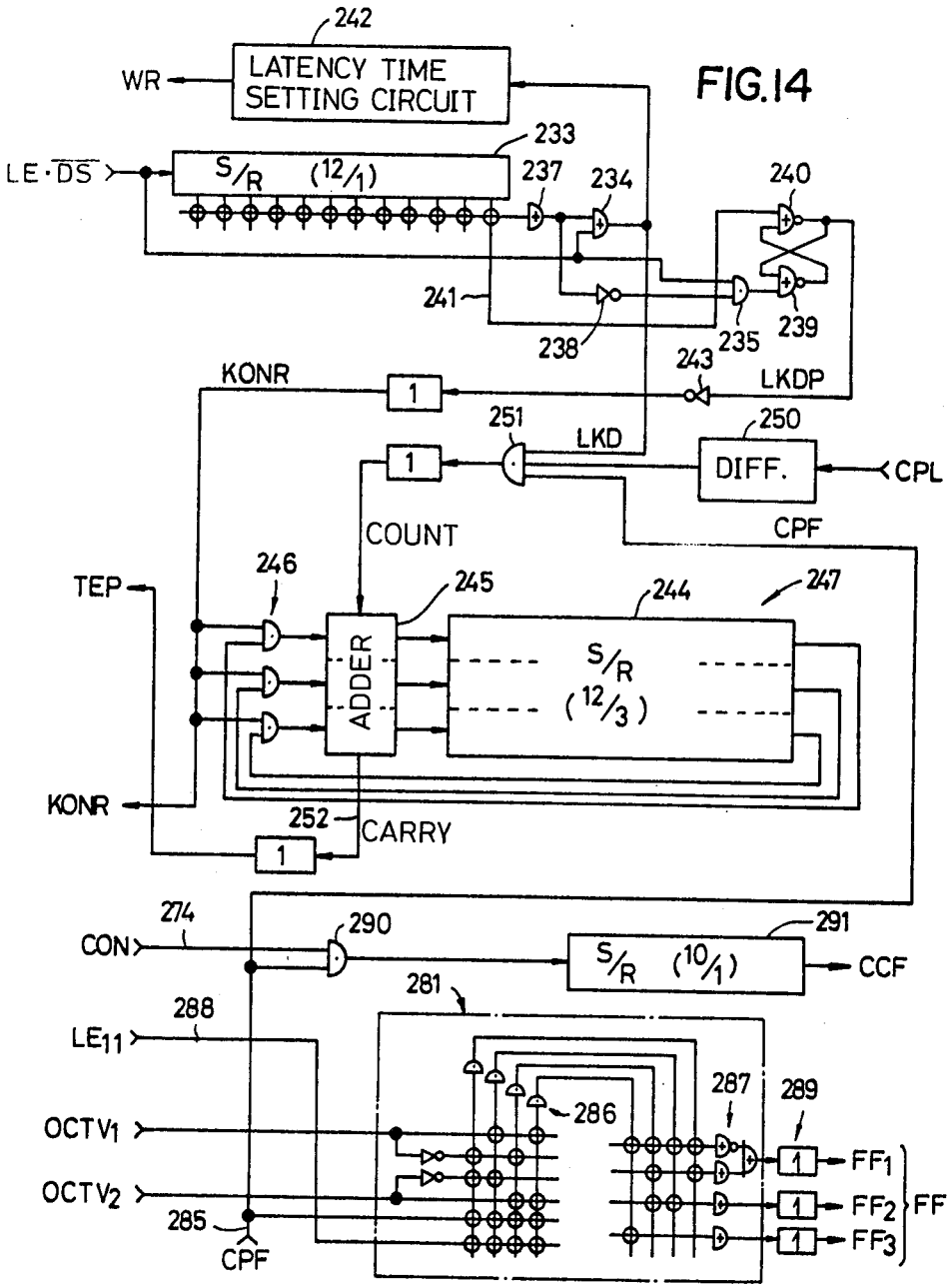
Figure 15:
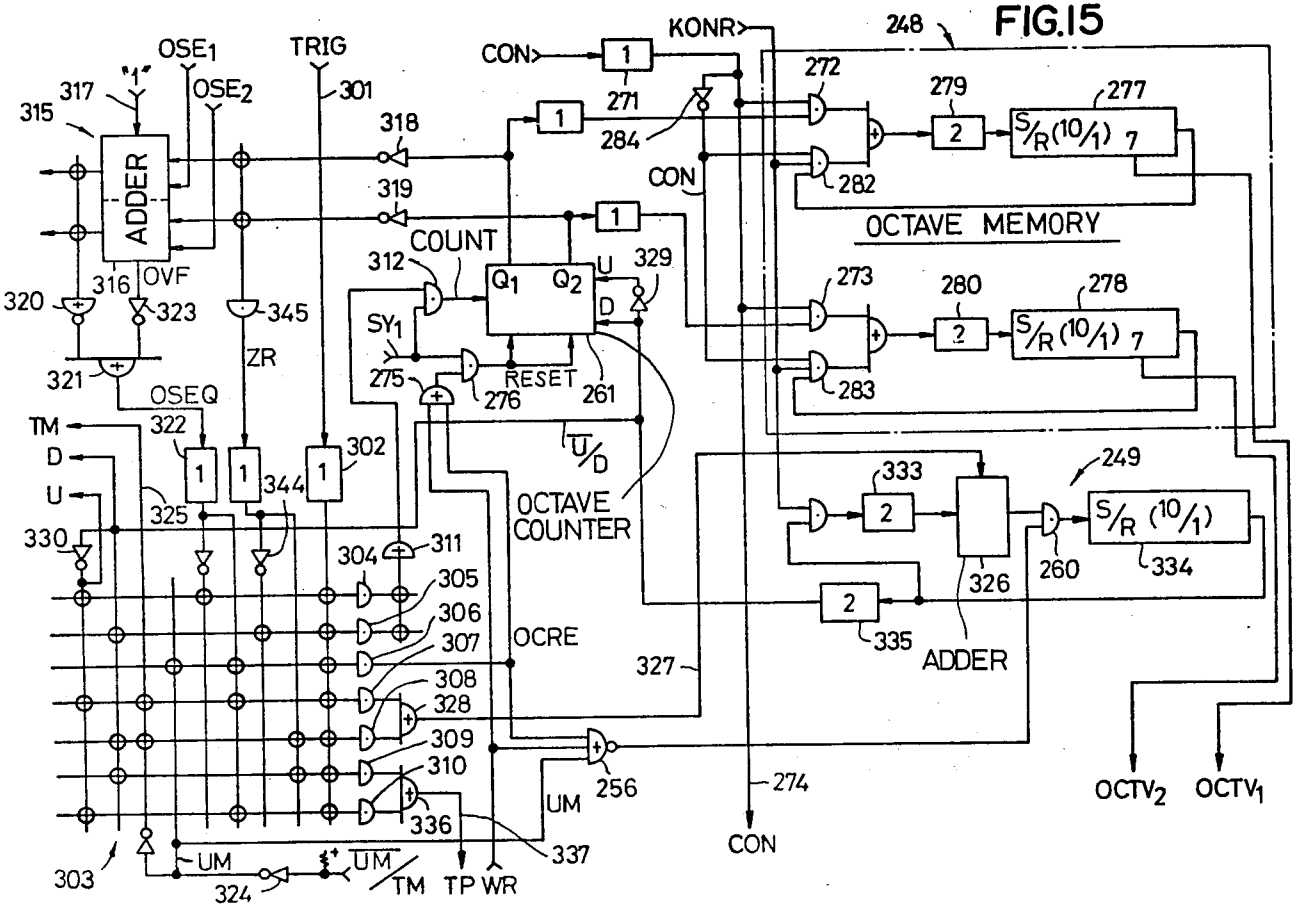

The chord pyramid performance control device 17 is illustrated in detail in FIGS. 13 through 15. In other words, FIGS. 13 through 15 are three parts of the circuit diagram illustrating the device 17. Out of the key code outputted in a time division manner by the channel processor 13, the note code $N_1$–$N_4$ and the octave code $B_1$–$B_3$ are applied through a delay flip-flop group 220 to a coincidence detection circuit 221 in FIG. 13. Applied to the other inputs of the coincidence detection circuit 221 is the count output of a chord pyramid counter 222 made up of a 7-bit up-down counter (modulo $2^6=108$). The count content of the counter 222 is advanced by one step every 12 microseconds; that is, the count content is maintained unchanged for 12 microseconds during which one circulation of the channel times is effected, as described later. When the key code $N_1$–$B_3$ coincides with the count value of the counter 222, a coincidence detection signal COIN is outputted by the coincidence circuit 221 for one microsecond that is the time width of the key code. As the coincidence detection signal COIN is provided irrespective of the kinds of keyboard, a coincidence detection signal COIN corresponding to a desired keyboard is selected by an AND circuit 223. In this example, as the automatic performance according to this invention is effected by using the lower keyboard, a signal representing the fact that the key code concerning the lower keyboard has been provided is applied to the other input line 224 of the AND circuit 223. In other words, it is detected by an AND circuit 225 that the content of the keyboard code $K_1$, $K_2$ out of the key code represents the lower keyboard ($K_2$="1", and $K_1$="0"), as a result of which a lower keyboard detection signal LES is applied to a shift register 226. In addition, the decay start signal DS is inverted by an inverter 227, and when this inverted signal is at "1", it is representative of key depression. Therefore, the inverted signal is applied to an AND circuit 229 through a delay flip-flop 228, and is then checked for AND conditions with the lower keyboard detection signal LES which has been delayed by one stage by the shift register. Thus, in the case of the lower keyboard key code, the output of the AND circuit 229 is raised to "1", which is applied through a line 224 to the AND circuit 223 to enable the latter 223. If in this operation the key code $N_1$–$B_3$ coincides with the count value of the counter 222, then the coincidence detection signal COIN is applied through the AND circuit 223 to an AND circuit 230.

The AND circuit 230 is enabled by a gate signal applied through a line 231. This gate signal applied to the line 231 is provided by a chord pyramid system control section 232. This chord pyramid system control section 232 operates to mainly control the count scanning operation of the chord pyramid counter 222. As will become more apparent later, while the counter 222 carries out its count scanning operation, the AND circuit 230 is enabled by the gate signal on the line 231.

A lower keyboard key depression signal LE.$\overline{\text{DS}}$ from the AND circuit 229 is applied to a shift register 233, an OR circuit 234, and an AND circuit 235 in FIG. 14. This lower keyboard key depression signal LE.$\overline{\text{DS}}$ represents that keys for chord pyramid performance have been depressed.

In FIG. 14, an OR circuit 237 receiving the outputs of all of the twelve stages of the shift register 233 outputs a signal "1" in a direct current mode if the tone production of at least one lower keyboard key code for chro chord pyramid performance is assigned to a channel. When the tone production of the lower keyboard key code is not assigned to a channel at all, the output signal of the OR circuit 237 is at "0", and in this case the output of an inverter 238 is at "1".

When, in starting the production of a chord pyramid tone, the lower keyboard key depression signal LE.$\overline{\text{DS}}$ concerning the first assigned key code among a plurality of key codes formed by the automatic bass chord performance control device 14 is firstly applied to the shift register 233, no lower keyboard key code has been applied thereto before, and therefore the signals of all the delay output stages f the shift register 23 are at "0". Thus, the output of the AND circuit 235 becomes "1" only for one micro-second during which the signal LE.$\overline{\text{DS}}$ is firstly applied to the shift register 233. This output "1" of the AND circuit 235 operates to set a flip-flop consisting of a NOR circuit 239 and a NOR circuit 240. When the signal "1" concerning the first lower keyboard key depression signal LE.$\overline{\text{DS}}$ is shifted to the last stage of the shift register 233 in 12 microseconds, the flip-flop (239 and 240) is reset by a signal "1" appearing on the output line 241 of the last stage. Therefore, the output of this flip-flop (the output of the NOR circuit 240), that is, a key depression initial pulse LKDP is a signal which will have "1" for 12 microseconds in starting the key depression for chord pyramid performance.

Applied to the OR circuit 234 are the output of the OR circuit 237 and the signal LE.$\overline{\text{DS}}$. The OR circuit 234 outputs a key depression indication signal LKD which is a signal "1" in a direct current mode when key depression is effected in the lower keyboard.

When the key depression indication signal LKD from the OR circuit 234 is raised to "1", a latency time setting circuit 242 is operated, so that a short latency time determined by taking key switch chattering and keyboard mistouching into acount is set. After this latency time, the level of a latency time setting reset signal WR is lowered to "0", as a result of which the resetting by the signal WR is released.

Performance Start

Referring to FIG. 14, the above-described key depression initial pulse LKDP is inverted by an inverter 243 so that it is utilized as a key depression initial reset signal KONR which has "0" for a time width of 12 microseconds. This signal KONR is to reset the contents of all the twelve channels of a predetermined counter in the initial period of key depression. The term "a predetermined counter" is intended to mean a counter which comprises a 12-stage shift register and an adder to carry out the counting operations for the channels in a time division manner; that is, a tempo clock frequency division circuit 247 made up of a 12-stage 3-bit shift register 244, an adder 245 and an AND circuit 246, and an octave memory circuit 248 and an up-down control memory 249 in FIG. 15 belong to the predetermined counter.

A fundamental tempo clock pulse CPL for chord pyramid is applied from a timing signal generating circuit (not shown) to a differentiating circuit 250, where the rising part of the pulse CPL is shaped into a pulse having a time width of 12 microseconds.

When both the above-described lower keyboad key depression indication signal LKD, and a chord pyramid selection signal CPF which is provided when the chord pyramid performance is selected in response to the closure of a chord pyramid performance selecting switch (not shown) are at "1", an AND circuit 251 selects the fundamental temp clock pulse CPL shaped into a pulse having a time width of 12 microsecond by the differentiating circuit 250, and applies it the count input of the adder 245 in the frequency division circuit 247. The frequency division circuit 247 is so designed that it can carry out its counting operations in a time division manner separately according to the channels; however, as the count pulses are applied with a time width of 12 microseconds, the same count contents are provided for all the channels. In the example, the frequency division circuit 247 carries out a $\frac{1}{8}$ frequency division, and the carry signal having a time width of 12 microseconds which is delivered to a line 252 when the most significant bit of the 3-bit half-adder 245 is caused to overflow will become a tone production timing pulse TEP. Accordingly, the tone production timing pulse TEP is a pulse having a time width of 12 microseconds obtained by subjecting the frequency of the fundamental tempo clock pulse CPL to $\frac{1}{8}$ frequency division.

The generation period T of this tone production timing pulse TEP corresponds to the tone production intervals between the tones produced in the chord pyramid performance. Accordingly, the tone production timing pulse TEP is produced approximately T time after it has become possible to select the fundamental tempo clock pulse CPL having a time width of 12 microseconds out of the AND circuit 251 by the initial key depression in the lower keyboard.

Incidentally, at the start of the chord pyramid performance, the tone production timing of a tone to be produced first depends not on the above-described tone production timing pulse TEP but on the decaying time of the above-described latency time setting rest signal WR. This is because if the generation of the initial tone production is waited then a time delay which can be clearly detected by the auditor's ears occurs between the key depression and the initial tone production. Therefore, the first chord pyramid tone is produced immediately after the latency time to improve the responsing characteristic between the key depression and the chord pyramid tone production start thereby to improve the capability in performance of the instrument.

In the latency time setting circuit 242 (in FIG. 14), when the set latency time is over, the level of the latency time setting reset signal WR is lowered to "0" from "1". When this reset signal WR is at "1", the chord pyramid counter 222, the coincidence code memory circuit 253, and delay flip-flop 254, 255 and 331 in FIG. 13 are reset to be ready for starting the chord pyramid performance. In FIG. 13, when the level of the reset signal WR is lowered to "0" from "1" (cf. the part (a) of FIG. 16), a negative differentiating circuit made up of a delay flip-flop 257, an AND circuit 258 and an inverter 259 in the chord pyramid system control section 232 provides a differentiating pulse having a time width of one microsecond in synchronization with the decay time of the signal WR; that is, a start pulse STAT (="1") having a time width of 1 microsecond is produced by the AND circuit 258 (cf. the part (b) of FIG. 16). In the chord pyramid system control section 232, the delay flip-flop 255 is to control the scanning count operation of the chord pyramid counter 222, while the delay flip-flop 254 is to secure a processing time when the carry signal is provided by the counter 22. The reset signal WR is applied through a NOR circuit 256 (FIG. 15) to an AND circuit 260 to disable the latter 260, whereby the memory of an up-down control memory 249 (FIG. 15) is set to "0", and the counter 222 (FIG. 13) and an octave counter 261 (FIG. 15) are placed in up-count stage.

First Tone Production

This will be described by referring also to the column 1T (time region) in FIG. 16.

When the start pulse STAT became "1", the output $H_2$ of the delay flip-flop 255 is at "0" (being reset by the reset signal WR), and therefore its inverted signal $\overline{H_2}$ is at "1". See part (c) of FIG. 16. As a result, the level of the output of the OR circuit 263 is raised to "1", and the signal "1" is written in the delay flip-flop 255 through the OR circuit 263. An AND circuit 264 is to circulate the memory of the flip-flop 255. The AND circuit 264 causes the logical value "1" of the output $H_2$ of the flip-flop 255 to be circulated and stored under the conditions that (1) no carry signal CARY is provided by the carry detection circuit 265 in the counter 222 (the output of the inverter 266 being "1"), and (2) no coincidence signal CON is provided through the AND circuit 230 (the output of hte inverter 267 being "1").

When the output $H_2$ of the flip-flop 255 has "1", the scanning count operation of the chord pyramid counter 222 is enabled. In other words, when a system pulse $SY_1$ is applied under the conditions that (1) the output signal $H_2$ of the flip-flop 255 is at "1", and (2) no coincidence signal CON is not provided (the output of the inverter 267 being "1"), an AND circuit 268 in the chord pyramid system control section 232 provides a count pulse $J_1$ in synchronization with the pulse $SY_1$ (the part (e) of FIG. 16). This count pulse $J_1$ is applied through an OR circuit 269 to the count input terminal of the chord pyramid counter 222. As indicated in the part (d) of FIG. 16, the system clock pulse $SY_1$ is generated in synchronization with a channel time with a period of 12 microseconds. Accordingly, the count of the counter 222 is advanced by one step every 12 microseconds by the count pulse $J_1$ until the coincidence signal CON is provided during the period in which the output $H_2$ of the count operation control delay flip-flop 255 is maintained at "1".

In addition, the content of the up-down control memory 249 (FIG. 15) is initially at "0", and therefore the up-count signal U is at "1" while the down-count signal D is at "0", and the count mode of the chord pyramid counter 222 is started at the up-count. Therefore, the content of the chord pyramid counter 222 is increased successively starting from "0". The count value of the counter 222 is compared with the key code $N_1$-$B_3$ in the coincidence detection circuit 211. In this case, while a series of key codes $N_1$-$B_3$ for all of the twelve channels are provided in a time division manner in 12 microseconds, the content of the counter 222 is maintained unchanged for that 12 microseconds. Accordingly, whenever the content of the counter 222 is advanced by one step, comparison of the content of the counter 222 with the contents of all the key codes $N_1$-$B_3$ whose tone productions are assigned to all the channels is carried out.

As shown in Table 1, the values of the key codes each consisting of a note code $N_1$-$N_4$ and an octave code $B_1$-$B_3$ are arranged in the order of increasing key tone pitch. In other words, the value of a key code concerning a low tone is low, while the value of a key code concerning a high tone is high. Therefore, when the content of the counter 222 which is being increased coincides with the value of the key code concerning the lowest tone out of the key codes $N_1$-$B_3$ assigned to the twelve channels, the first coincidence detection signal COIN is provided by the coincidence detection circuit 221 (the part (h) of FIG. 16). If, as described before, this signal is for the lower keyboard, it COIN is applied to the AND circuit 230 through the AND circuit 223. The output $H_2$ of the flip-flop 255 representing the fact that the scanning count operation is being carried by the counter 222 has been applied to the gate line 231 of the AND circuit 230. Therefore, if the coincidence detection signal COIN (concerning the lower keyboard) is provided while the scanning count operation is carried out by the chord pyramid counter 222, then the coincidence signal CON "1" is outputted by the AND circuit 230 (the part (i) of FIG. 16).

By the coincidence signal CON "1" the output level of the inverter 267 is lowered to "0" to disable a circulating AND circuit 264, as a result of which in 1 microsecond the level of the output $H_2$ of the flip-flop 255 is lowered to "0". As a result, the scanning count operation of the counter 222 is suspended, and the AND circuit 230 is disabled. Therefore, only one coincidence signal CON is produced with a time width of 1 microsecond in correspondence to the channel time to which the key code $N_1$-$B_3$ coincident with the content of the counter 22 is assigned.

For instance, in the case where as indicated in the part (b) of FIG. 10, the key of note $C_5$ has been depressed in the lower keyboard, and the key codes for notes $E_5$ and $G_5$ which are in the relations of major third and perfect fifth intervals with respect to note $C_5$, respectively, have been provided, the first coincidence signal CON is produced in correspondence to the lowest note $C_5$ among these notes. Hereinafter, the description will be made with the assumption that the key codes for the three notes have been provided.

The signal "0" outputted by the inverter 267 when the level of the coincidence signal CON is raised to "1" is applied to the inverter 270, and therefore the output of the inverter 270 will have "1" in synchronization with the coincidence signal CON. This output "1" is employed as a writing instruction signal $LOAD_2$ for the coincidence code memory circuit 253. When this signal $LOAD_2$ (the part (j) of FIG. 16) is applied to the coincidence code memory circuit 253, the present count content of the chord pyramid counter 222 is written in the coincidence code memory circuit 253. Thus, the count data whose content is the same as that of the key code $N_1$-$B_3$ allowing the coincidence signal CON to be produced is stored in the coincidence code memory circuit 253. In the case of note $C_5$, the data "0111110" equal to the key code ($B_3$, $B_2$, $B_1$, $N_4$, $N_3$, $N_2$, $N_1$) is stored.

The coincidence signal CON is applied to a delay flip-flop 271 for timing coincidence in FIG. 15, and the coincidence signal CON delay by one microsecond thereby is applied to AND circuits 272 and 273 in the octave memory circuit 248 to enable the circuit 272 and 273. In addition, the concidence signal CON is applied through a line 274 to the circuit in FIG. 14. The bit outputs $Q_1$ and $Q_2$ of the octave counter 261 (FIG. 15) are applied respectively to the AND circuits 272 and 273. As the counter 261 has been reset by the latency time setting reset signal WR applied thereto through an OR circuit 275 and an AND circuit 276, the count output $Q_1$, $Q_2$ is "0 0". The fact that the content of the octave counter is "0" means that tone production should be effected in the octave range specified by the key code KC outputted by the channel processor 13. The octave memory circuit 248 is employed as a memory circuit which operates to store the count contents of the octave counter 261 separately according to the channels as a 12-stage 2-bit circulating shift register comprising 2-stage shift register 279 and 280 and 10-stage shift register 277 and 278 (however, the memory contents for all the channels are equal). The content of the octave counter 261 written in the octave memory circuit 248 with the aid of the coincidence signal CON is read out of the seventh output stages of the shift registers 277 and 278 threrein, and is then supplied as octave instruction signal $OCTV_1$, $OCTV_2$ to an octave encoder 281 in FIG. 14.

AND circuits 282 and 283 in FIG. 15 are to circulate the memories in the shift registers 279 and 277, and 280 and 278. More specifically, upon provision of the coincidence signal CON, the count content of the octave counter 261 is written in the octave memory circuit 248 through the AND circuits 272 and 273; however, when the coincidence signal CON is not provided, the storage in the octave memory circuit 248 is held through the AND circuits 282 and 283 by the output "1" ($\overline{CON}$) of the inverter 284.

When the first coincidence signal CON is produced by the circuit of FIG. 13 as described above this signal CON is applied through the circuit of FIG. 15 to the circuit of FIG. 14, whereby a tone production instruction signal CCF necessary for chord pyramid tone production is provided and the value of an octave switching designation signal FF ($FF_1$-$FF_3$) is rewritten according to the content of the octave encoder 261.

In the octave encoder 281 in FIG. 14, the octave instruction signal $OCTV_1$, $OCTV_2$ supplied thereto by the octave memory circuit 248 is encoded as indicated Table 6 below. In Table 6, the octave slide amount 0 indicates the octave range specified by the key code KC, and the octave slide amount 1, 2 and 3 indicate the octave ranges which are higher by one, two and three octaves than the octave range determined by depressing a key, respectively.

TABLE 6

| INPUT | | OUTPUT | | | |
|---|---|---|---|---|---|
| $OCTV_2$ | $OCTV_1$ | $FF_3$ | $FF_2$ | $FF_1$ | Octave sliding data |
| 0 | 0 | 0 | 0 | 1 | 0 |
| 0 | 1 | 0 | 1 | 0 | 1 |
| 1 | 0 | 0 | 1 | 1 | 2 |
| 1 | 1 | 1 | 0 | 0 | 3 |

Under the conditions that a chord pyramid performance selecting switch (not shown) is closed and the selection signal CPF on the line 285 is at "1", the octave switching designation signals $FF_1$-$FF_3$ for the first musical tone forming system 15 (hereinafter referred to as "a harmonic composing system 15" when applicable) are produced according to the contents of the octave instruction signal $OCTV_1$, $OCTV_2$ in the encoder consisting of an AND circuit group 286 and an OR circuit group 287. The octave switching designation signal VF and tone production instruction signal CCV for the second musical tone forming system 16 are not indicated in FIGS. 13 through 15, because these signals are not produced when the automatic bass chord performance control device 14 is operated.

In order that the octave switching designation signal FF is produced only for the channel time to which the key code of the lower keyboard for chord pyramid performance is assigned, a lower keyboard detection signal $LE_{11}$ delayed by 11 microseconds by the shift register 226 in FIG. 13 is applied through the line 288 to the encoder 281 (FIG. 14).

There is a time delay of just 12 microseconds between the time instant when the key code which has had coincidence in the coincidence detection circuit is applied to the chord pyramid performance control device 17 and the time instant when the octave switching designation signal $FF_1$-$FF_3$ concerning that key code is produced; 2 microseconds in the delay flip-flops 220 and 271; 9 microseconds in the seventh stages of the shift registers 279 and 280, and 277 and 278; and 1 microsecond in the delay flip-flop group 289 at the output side of the octave encoder 281. For the same reason, the lower keyboard detection signal LES is delayed by 11 microseconds by the shift register 226 to provide the signal $LE_{11}$.

As was described before, in the case of the first tone the octave instruction signal $OCTV_1$, $OCTV_2$ is "0 0". Therefore, only the bit $FF_1$ off the octave switching designation signal FF has a "1", designating that tone production should be effected in an octave range indicated by the key code KC.

The coincidence signal CON having a time width of 12 microseconds supplied through the line 274 is applied to the AND circuit 290 in FIG. 14. In chord pyramid performance, the AND circuit 290 has been enabled by the above-described selection signal CFF "1". Therefore, the coincidence signal CON is applied through the AND circuit 290 to a 10-stage shift register 291. The coincidence signal CON outputted by the shift register 291 becomes a harmonic composing system chord pyramid tone production instruction signal CCF.

Similarly as in the case of the octave switching designation signal FF, the tone production instruction signal CCF is provided 12 microsecond after the key code $N_1$-$B_3$ providing the coincidence signal CON has been applied to the pyramid performance control device 17, because it is delayed by 2 microseconds by the delay flip-flops 220 and 271 and by 10 microseconds by the shift register 291. Accordingly, the key code KC, the octave switching designation signal FF, and the tone production instruction signal CCF which are supplied to the musical tone forming system 15 are in synchronization with one another in time channel.

In the envelope generator 23 (FIG. 1) in the musical tone forming system 15 to which the chord pyramid tone production instruction signal CCF is supplied, when the clear signal is applied to the envelope counter 39 in response to the signal CCF, the count content of the counter 39 is cleared to "0". Therefore, when the tone production instruction signal CCF is decayed (more specifically, when the level of the signal CCF is lowered to "0" at the channel time 12 microseconds later than the channel time at which the signal CCF has become a signal "1" having a time width of 1 microsecond the counting operation of the envelope counter 39 is started from "0", and a percussive envelope signal $EV_1$ as indicated in FIG. 3 is generated by the envelope-generator 23 at the relevant channel time. Accordingly, the musical tone of a note (which is note $C_5$ employed as the first tone in the above-described example) assigned to the relevant channel is produced by the musical tone forming system 15 in response to the rising of the percussive envelope signal $EV_1$, and the produced tone $C_5$ is decayed with the envelope signal $EV_1$.

As was described before, the octave slide amount is "0" in the case of the first tone. Therefore, even if the octave switching designation signal FF is applied to the foot change circuit 32 of the musical tone forming system 15 at the same channel time as that of the tone production instruction signal CC, the value of the output qF of the accumulator 28 is not changed. Accordingly, the first tone, for instance note $C_5$, is produced in the octave range designated by the key code KC.

Tone Production of the Second Tone, and so forth

Since the chord pyramid fundamental temp clock CPL forms the fundamental tempo of a note which can be clearly sensed by the ears, it is sufficiently longer than a period of time required for the count scanning operation which is carried out by the chord pyramid counter 22 with twelve microseconds as one unit. Therefore, it can be considered that the counting of the clock pulses CPL by the frequency division circuit 247 is started at the time instant when the tone production of the first tone for chord pyramid performance is started as described above (at the time instant when the first coincidence signal is provided). Thus, the carry signal is delivered to the line 252 (FIG. 14) by the frequency division circuit 247 approximately a period of time T after the tone production of the first tone has started, and this carry signal is applied as a tone production timing pulse TEP having a time width of 12 microseconds, to the AND circuit 292 in the chord pyramid system control section 232 (FIG. 13) (the part (k) of FIG. 16). This tone production timing pulse TEP is produced every period of time T which is a period eight times as long as the clock pulse CPL.

For the second tone and so forth, the count scanning operation of the chord pyramid counter 222 is started in response to the tone production timing pulse TEP, and upon provision of the coincidence signal CON the tone production of the chord pyramid tone is effected. The coincidence signal (CON) generation control timing charts with respect to the second and third tones are indicated in the columns of 2T and 3T time regions.

In FIG. 13, the tone production timing pulse TEP having a time width of 12 microseconds is selected as much as one microsecond by the AND circuit 292 in synchronization with the system clock pulse $SY_1$ having a time width of one microsecond and a period of twelve microseconds, to form a tone production timing pulse $TEP_1$ having a time width of one microsecond. The timing pulse $TEP_1$ is applied to the OR circuit 269 and the AND circuit 293 (the part (1) of FIG. 16).

As was described before, when the coincidence signal CON concerning the first tone has been outputted, the storage in the delay flip-flop 255 has become "0". Therefore, the level of the signal $\overline{H_2}$ which is the other input of the AND circuit 293 (the signal obtained by inverting the output $H_2$ of the flip-flop 255 by the inverter) is at "1". Under this condition, the tone production timing pulse $TEP_1$ having a time width of one microsecond is applied thereto, as a result of which the signal "1" is applied to the flip-flop 255 through the AND circuit 293 and the OR circuit 263. Therefore, in one microsecond the level of the output signal $\overline{H_2}$ of the flip-flop 255 is raised to "1", and is circulated and stored through the AND circuit 264. When the level of the signal $H_2$ is raised to "1", the count scanning operation of the chord pyramid counter 222 is started again as was described above.

At the time instant when the coincidence signal CON concerning the first tone was provided, the counting operation of the chord pyramid counter 222 was suspended. Therefore, the state of the counter 222 is such that the count value equal to that of the key code $N_1$-$B_3$ for the first tone (note $C_5$) is maintained therein. If with this previous coincidence code the count scanning operation is started to open the gate of the AND circuit 230 with the signal $H_2$, then the same coincidence signal CON as that of the previous coincidence code is provided. This is undesirable. In order to prevent the occurrence of such an undesirable phenomenon, the tone production timing pulse $TEP_1$ of one microsecond time width is applied, as a count pulse $J_2$ (=$TEP_1$), to the count input of the chord pyramid counter 222 through the OR circuit 269 (the part (f) of FIG. 16). The time instant when the level of the signal $H_2$ is raised to "1" is later by 1 microsecond than that of the tone production timing pulse $TEP_1$ (count pulse $J_2$) because of the presence of the flip-flop 255. Therefore, immediately before the counter 222 is made to be ready for count scanning operation (that is, the count pulse $J_1$ is applied through the AND circuit 268 every 12 microseconds while the AND circuit 230 is enabled through the gate line 231) by raising the level of the signal $H_2$ to "1", a single count pulse $J_2$ is applied to the chord pyramid counter 222 thereby to advance the content of the counter 22 by one step when compared with that for the previous coincidence code.

Under this condition that the content of the chord pyramid counter 222 is advanced by one step further than that for the previous coincidence code, the coincidence detection operation for the next tone (the second tone) production is started again.

As the count value of the counter 222 is increased, it reaches the key code value concerning the key of a tone (note $E_5$) higher in tone pitch than the previous tone (note $C_5$). In this operation, a coincidence signal CON having a time width of one microsecond is produced in correspondence to the channel time to which the note $E_5$ has been assigned. Similarly as in the above-described case, the level of the signal $H_2$ is lowered to "0", the counting operation of the counter 222 is suspended, and a coincidence code writing instruction signal LOAD 2 is applied through the inverter 270 to the coincidence code memory circuit 253. Therefore, the storage in the memory circuit 253 is rewritten into the data "1000100" which is the same as that of the key code $B_3$, $B_2$, $B_1$, $N_4$, $N_3$, $N_2$, $N_1$ of the note $E_5$. In a manner as described above, the data stored in the coincidence code memory circuit 253 is rewritten into a new data (coincidence key code) whenever the coincidence signal CON is generated.

Upon generation of the coincidence signal CON, the harmonic composing system chord pyramid tone production instruction signal CCF having a time width of one microsecond is generated in synchronization with the channel time to which the key code providing the coincidence signal CON has been assigned, as a result of which the tone production is effected in the relevant channel in the musical tone forming system 15. In addition, the octave switching designation signal FF is maintained unchanged unless the count content of the octave counter 261 (FIG. 15) is changed.

Whenever the tone production timing pulse TEP is provided by the frequency division circuit 247 (FIG. 14) as described above, that is, with the period T, the count scanning operation offthe counter 222 is started again and the coincidence signal CON is provided. In the case where the count value of the counter 222 is increased in the count scanning operation (the up-count signal U being "1"), the key codes coincides with the contents of the counter 222 in the order of increasing tone pitch. Therefore, in the above-described example, the coincidence signal CON concerning the second tone is generated in accordance with the key code of note $E_5$, while the coincidence signal CON concerning the third tone is generated in accordance with the key code of note $G_5$.

Accordingly, when the chord pyramid counter 222 is in an up-count mode, the tones are produced successively in the order of increasing tone pitch. On the other hand, when it is in a down-count mode, the tones are produced successively in the order of decreasing tone pitch. In this connection, briefly stating, the tone production interval thereof is equal to the period T of the tone production timing pulse TEP.

In addition, the same code as the key code $N_1$-$B_3$ which caused to provide the coincidence signal CON previously has been stored in the coincidence code memory circuit 253 (FIG. 13). For instance, when the count scanning operation of the counter 222 is effected for the coincidence detection for the third tone production, the key code of the note $E_5$ which is the previous (the second tone's) coincidence code has been stored in the coincidence code memory circuit 253. When the key code of note $G_5$ coincides with the content of the counter 222 to provide the coincidence signal COn and tone of note $G_5$ is produced as the third tone, the key code of note $G_5$ is stored in the coincidence code memory circuit 253. And when the count scanning operation of the counter 222 is effected for tone production of the fourth tone, the previous key code of note $G_5$ has been stored, as it is, in the coincidence code memory circuit 253.

In response to (the decaying of) the tone production instruction signals CCF having a time width of one microsecond which are generated in synchronization with the channel times to which notes $E_5$, $G_5$ . . . that is, the second, third, . . . tones have been assigned, the envelope signals $EV_1$ are generated successively (every period of time T), the tones of notes $E_5$, $G_5$ . . . are produced successively.

Octave Slide Control (I)

The octave slide amount designated by the octave switching designation signal FF corresponds to the content of the octave counter 261 (FIG. 15). The count content of the octave counter 261 is advanced by one count when the carry signal CARY is provided by the chord pyramid counter 222. Therefore, the octave of a producing tone is maintained unchanged until a series of count scanning operations has been completed by the chord pyramid counter 222. Upon provision of the carry signal CARY, the octave of the producing tone is changed.

The carry signal CARY is produced by a carry detection circuit 265 (FIG. 13) which comprises an AND circuit 294 and a NOR circuit 295 to which the up-count instruction signal U and all the bit outputs of the counter 222 are applied. The AND circuit 294 is enabled by the signal U "1" representative of the up-count operation of the counter 222, and it produces a carry detection output "1" when the output of the counter 222 becomes maximum (all the output bits being at "1"). This output "1" of the AND circuit 294 is applied to the OR circuit 296 whereby it becomes the carry signal CARY in the up-count operation of the counter 222. The NOR circuit 295 is enabled by the signal U "0" representative of the down-count operation of the counter 222 (the down-count instruction signal D being at "1"), and it outputs a carry detection output "1" when the output of the counter 222 becomes minimum (all the bit outputs being at "0"). This output "1" of the NOR circuit 295 is applied to the OR circuit 296, where it becomes the the carry signal CARY in the down-count operation of the counter 222.

Accordingly, in the case where the chord pyramid counter 222 is in an up-count mode, the carry signal CARY is provided (by the AND circuit 294) in the count scanning operation of the counter 222 which is started again a period of time T after the coincidence signal CON concerning the key code of the key of the highest tone pitch out of the keys specified by the key codes KC. On the other hand, in the case where the chord pyramid counter 222 is in a down-count mode, the carry signal CARY is provided in the count scanning operation of the counter 222 which is started again a period of time T after the coincidence signal CON concerning the key code of the key of the lowest tone pitch out of the keys specified by the key codes KC. Upon provision of the carry signal CARY, the count scanning operation of the counter 222 is suspended once, but it is started again when the processing of the carry signal is completed.

It is assumed that the tone $C_5$ which is the highest in tone pitch among the three tones ($C_5$, $E_5$ and $G_5$) automatically formed is produced as the third tone. In this case, the key code of the tone $G_5$ is stored in the coincidence code memory circuit 253 (FIG. 13). If the time T after the tone production of the third tone has been effected, the tone production timing pulse TEP is provided, and is applied to the chord pyramid system control section 232, the level of the signal $H_2$ is raised to "1" to start the count scanning operation of the counter 222 again. Thus, the count clock pulse $J_2$ is applied to the counter 222 which has been stopped at the same value as that of the key code $N_1$-$B_3$ of note $G_5$, as a result of which the count value of the counter 222 has the value obtained by adding one (1) to the value of the key code of note $G_5$, and thereafter the count pulse $J_1$ is applied thereto with the timing of the system clock pulse $SY_1$. The count value of the counter 222 is increased by the count pulse $J_1$; however, as the key code $N_1$-$B_3$ whose value is larger than that of the key code of note $G_5$ is not applied thereto (at least with respect to the lower keyboard), no coincidence signal CON is produced, and the count value of the counter 222 will have the maximum value "1111111". As a result, the carry signal CARY is provided through the AND circuit 294 (the part (m) of FIG. 16).

When the level of the carry signal CARY is raised to "1", the level of the output of the inverter 266 is lowered to "0". As a result, the AND circuit 264 is disabled, the storage in the delay flip-flop 255 is erased, and in one microsecond the level of the signal $H_2$ is lowered to "0" (cf. the column of 4T time region in FIG. 16).

If the system clock pulse $SY_1$ is provided while the carry signal CARY is being supplied, under the condition that the signal "1" has not stored in the delay flip-flop 254 yet the output "1" is provided by the AND circuit 297 and is stored through the OR circuit 298 in the flip-flop 254. In one microsecond the output $H_1$ of the flip-flop 254 becomes "1", and in this case the signal "1" is circulated through the AND circuit 299 and stored in the flip-flop 254 as the system clock pulse $SY_1$ has been lowered to "0". When the system clock pulse $SY_1$ is supplied in 12 microseconds, the AND circuit 299 is disabled. Therefore, the storage in the flip-flop 254 is cancelled. Thus, the signal $H_1$ will have "1" only for the time width of 12 microseconds as indicated in the part (n) of FIG. 16.

Figure 16:
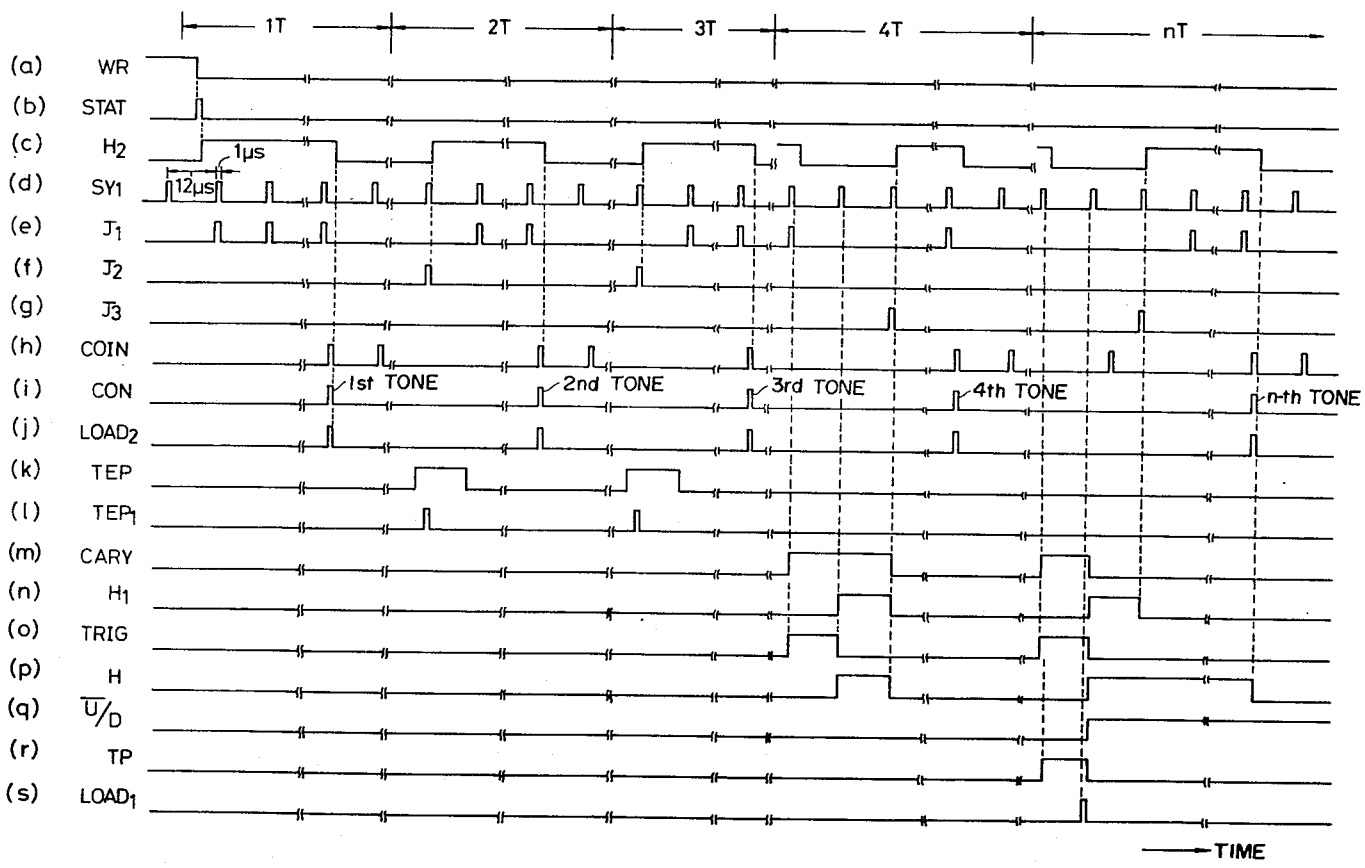
FIG. 16 is a timing chart for a description of the operation of a chord pyramid system control section shown in FIG. 13.

For the period of time of from the generation of the carry signal CARY until immediately before the level of the output $H_1$ of the flip-flop 254 is raised to "1", the conditions of the AND circuit 300 are satisfied, and an octave switching pulse TRIG having a time width of 12 microsecond is provided (the part (o) of FIG. 16). This octave switching pulse TRIG is applied through the line 301 to a delay flip-flop 302 for timing coincidence in FIG. 15 and to AND circuits 304 through 310 in an octave up/down control circuit 303. In the case where the octave sliding data (the content of the octave counter 261) pertaining to the present performance has not reached a value set by an octave sliding data setting switch (not shown), the AND circuit 304 provides its output "1", and the signal "1" is applied through an OR circuit 311 to an AND circuit 312. As the system clock pulse $SY_1$ is applied to the AND circuit 312, a signal "1" having a time width of one microsecond is outputted by the AND circuit 312 with the timing of the pulse $SY_1$ and is applied to the count input of the octave counter 261. Thus, the count value of the counter 261 is increased by one count.

If the system clock pulse $SY_1$ is provided when the signal $H_1$ produced with the aid of the carry signal CARY is at "1" while the signal $H_2$ is at "0", a count pulse $J_3$ is provided by an AND circuit 313 (FIG. 13) as indicated in the part (g) of FIG. 16. The count pulse $J_3$ thus provided is applied through the OR circuit 269 to the chord pyramid counter 222. In addition, under the completely same conditions as those of the aforementioned AND circuit 313, a signal "1" is outputted by an AND circuit 314 (FIG. 13), and is stored in the flip-flop 255. Accordingly, one microsecond after the count pulse $J_3$ has been provided the level of the signal $H_2$ is raised to "1", as a result of which the count scanning operation of the counter 222 is started again.

Since the up-count instruction signal U is still applied to the counter 222, the count value of the counter 222 is increased starting from the minimum value "0". When the count value of the counter 222 coincides with the key code of the key of the lowest tone (note $C_5$), the coincidence signal CON is provided, as a result of which the tone production of the fourth tone is started. In addition, when the AND circuits 272 and 273 in the octave memory circuit 248 (FIG. 15) are enabled by the coincidence signal relating to the fourth tone, the count content of the octave counter 261 has been increased by one count. Therefore, the data "0 1" representing the octave sliding data "1" is stored in the circuit 248. Thus, the octave switching designation signal $FF_1$, $FF_2$, $FF_3$ will have "0 1 0", and the tone of note $C_5$ concerning the key code which has produced the coincidence signal CON is slide upward by one octave into the tone of note $C_6$.

The content of the octave counter 261 is maintained unchanged until the next carry signal CARY is provided. Therefore, the coincidence signal CON concerning the key codes of notes $E_5$ and $G_5$ as the fifth and sixth tones are provided thereafter. In this case, even if the contents of the key codes KC outputted by the channel processor 13 (FIG. 1) are for the notes $E_5$ and $G_5$, they are changed into notes $E_6$ and $G_6$, higher by one octave, by the octave switching designation signals FF in the foot change circuit 32, respectively. Thus, the tones of notes $E_6$ and $G_6$ are successively produced as the fifth and sixth tones.

Octave Slide Control (II)

The maximum octave slide amount is set with an octave sliding amount setting switch (not shown) as desired by the performer. According to the value set by this switch, an octave sliding data setting signal $OSE_1$, $OSE_2$ (FIG. 15) is provided. The relation between the signal $OSE_1$, $OSE_2$ and the octave sliding amount is as indicated in Table 7 below:

TABLE 7

| $OSE_1$ | $OSE_2$ | Octave sliding data |
|---|---|---|
| 0 | 0 | 0 (octave) |
| 1 | 0 | 1 |
| 0 | 1 | 2 |
| 1 | 1 | 3 |

The meaning of the octave slide amount 0, 1, 2 and 3 in Table 7 is the same as that in Table 6. In this example, tone pitch can be varied over the range of maximum four octaves including the original octave related directly to key depression; however, it goes without saying that the number of octaves is not limited thereto.

The octave slide amount setting signal $OSE_1$, $OSE_2$ is applied to an octave comparison circuit 315 in FIG. 15. The data $OSE_1$ and $OSE_2$ have weights of a lower bit and a higher bit, respectively. The octave comparison circuit 315 is constituted as a subtractor which operates to subtract the count output of the octave counter 261 from the octave slide amount setting signal $OSE_1$, $OSE_2$. As subtraction is effected by carrying out complementary operation in the adder 316 (the signal "1" being applied to the lower bit from the line 317 at all times), the count output of the octave counter 261 is inverted by inverters 318 and 319 and is then applied to the other input of the adder 316. In other words, in the octave comparison circuit 315, 2-bit binary numbers are subjected to subtraction; that is, the octave slide amount setting binary number "$OSE_2$, $OSE_1$" is subtracted by the present performance octave slide amount "$OCTV_2$, $OCTV_1$".

When the present octave slide amount reaches the set value, the result of the subtraction has "0 0", and therefore the output of the adder 316 has "0 0". A NOR circuit 320 receiving the output of the adder 316 detects the fact that the present octave slide amount has reached the set octave slide amount, and produces its output "1". This output "1" of the NOR circuit 320 is applied, as an octave slide amount coincidence signal OSEQ, to the octave up/down control circuit 303 through an OR circuit 321 and a delay flip-flop 322 for timing coincidence.

When the present octave slide amount ($OCTV_1$, $OCTV_2$) is equal to or less than the set octave slide amount ($OSE_1$, $OSE_2$), in complementary operation an overflow signal OVF (="1") is outputted by the adder 316 at all times. In the case when the set value $OSE_1$, $OSE_2$ is decreased by operating the switch during the performance, sometimes the present octave slide amount may be larger than the set octave slide amount. In this case, no overflow signal OVF is provided in the complementary operation, and therefore the output level of the inverter 323 is raised to "1", and the octave coincidence signal OSEQ is falsely provided through the OR circuit 321.

Up Mode and Turn Mode

The term "up mode" is intended to mean a mode in which a plurality of tones (three tones in the example) in a predetermined interval relation automatically formed are produced one at a time in the order of increasing tone pitch, and this successive tone production is repeated over one through plural octaves, whereby the tone pitch increment is repeatedly carried out. The term "turn mode" is intended to mean a mode in which the plurality of tones are produced successively in the order of increasing tone pitch, and are then produced successively in the order of decreasing tone pitch, hwereby the tone pitch increment and decrement are repeated over one through plural octaves. In the example, one of the up mode and turn mode can be selected as desired.

The significant difference in signal processing between the up mode and the turn mode resides in the difference in processing when the aforementioned octave coincidence signal OSEQ is provided.

For selecting the up mode, an up mode selecting switch (not shown) is closed to lower the level of a selection signal $\overline{UM}$/TM to "0". As a result, the level of the up mode selection signal UM is raised to "1" by an inverter 324 (FIG. 15), while the turn mode selection signal TM is lowered to "0". Signals from AND circuits 307 and 308 in the octave-up/down control circuit 303 are applied through an OR circuit 328 to the count input line 327 of an adder 326 in the up-down control memory 249 (FIG. 15). As the turn mode selection signal TM on the line 325 is applied, as an operating condition, to the AND circuits 307 and 308 in the case when the up mode has been selected the signal "1" is not applied the count input line 327 of the up-down control memory 249, and therefore the signal "0" is maintained stored in the memory 249. In addition, as the up mode selection signal UM is inverted by the NOR circuit 256 to disable the AND circuit 260 in the memory 249, the storage in the memory 249 is maintained at "0". Thus, when the chord pyramid performance in the up mode has been selected, the signal "0" representative of up-count is stored in the up-down control memory 249 at all times. Accordingly, the level of the up-count instruction signal U obtained by inverting the output of the memory 349 by an inverter 329 or 330 is at "1" at all times, and the octave counter 261 and the chord pyramid counter 222, which are formed as up-down counters, are set in the up-count mode at all times.

It is assumed that the octave sliding data of a chord pyramid tone being performed is coincident with the set value $OSE_1$, $OSE_2$. In this case, the octave coincidence signal OSEQ has been provided through the OR circuit 321 by the octave comparison circuit 315 and has been applied to the AND circuits 306, 307 and 310 in the octave up/down control circuit 303. The AND circuit 307 is disabled by the turn mode selection TM "0", while the AND circuit 306 is enabled by the up mode selection signal UM and the AND circuit 310 is also enabled by the up-count instruction signal U from the inverter 330. If under this condition the content of the chord pyramid counter 222 (FIG. 13) reaches the maximum value to generate the carry signal CARY, the chord pyramid system control section 232 operates similarly as in the above-described case to process the carry signal CARY, whereby the octave switching pulse TRIG is generated and the storage of the flip-flop 254 is set ($H_1$="1"). When the octave switching pulse TRIG having a time width of 12 microseconds is applied to the AND circuits 306 and 310 through the line 301 and the delay flip-flop 302, the AND circuits 306 and 310 provides outputs "1" as they have been enabled by the octave coincidence signal OSEQ. The output "1" of the AND circuit 306 is applied, as an octave reset signal OCRE, to the AND circuit 276 through the OR circuit 275. In the AND circuit 276 the octave reset signal OCRE is formed into a pulse having a time width of one microsecond with the timing of the system clock pulse $SY_1$ and is applied to the reset input of the octave counter 261. Thus, the content of the octave counter 261 is reset to the count value "0".

Simultaneously when the octave counter 261 is reset with the timing of the system clock pulse $SY_1$, the count pulse $J_3$ is provided by the AND circuit 313 in the chord pyramid system control section 232 as described before. Accordingly, the count value of the counter 222 is increased by one count from the maximum value "1111111", and therefore the counter 222 overflows to have the count value "0". Thus, the count value of the counter 222 is increased starting from "0" again. In addition, the count value of the counter 261 is also returned to the count value "0", and the count value thereof is increased to "1", "2", and so on whenever the octave switching pulse TRIG is applied thereto. It should be noted that the output of the AND circuit 310 is not employed in the up mode.

In the up mode, the chord pyramid counter 222 is placed in the up-count mode at all times, and therefore the coincidence signals CON are produced successively in the order of increasing tone pitch for the tones of keys being depressed. In addition, the content of the octave counter 261 is increased at all times, but it is reset whenever the deviation in tone pitch of the chord pyramide tone reaches the set octave sliding data. In other words, the tones are produced successively in the order of increasing tone pitch starting from the octave range represented by the key code KC, and then the tones are produced successively in the order of increasing tone with the tone pitches are increased by one octave. When the deviation in tone pitch effected by increasing the octave reaches the set octave sliding data, the tone production is returned to the initial octave specified by the key code so as to repeat the tone production effected in the order of increasing tone pitch.

Thus, the tones related to the plural key codes KC automatically formed (the term "related tones" intending to mean the tone of the key code and the tones which are in octave relation to the firstly mentioned tone) are produced one at a time in the order of increasing tone pitch over one or plural octaves and with predetermined intervals T, and this increment in produced tone pitch is repeated. (It goes without saying that the increment may be made only once.) An automatic performance mode such as described above is the up mode in the chord pyramid performance. With respect to the term "over one or plural octaves", it should be noted that the octave changing range (or the octave sliding data) is set by operating the octave sliding data setting switch. The part (a) of FIG. 17 indicates an example of a tone production state in the case where three tones ($C_5$, $E_5$ and $G_5$) automatically formed are subjected to tone production control in the up mode. In this example indicated in the part (a) of FIG. 17, the octave sliding data is set to "1". In this case, the tone pitch is increased by one octave, and therefore the variation in tone pitch over two octave can be effected.

For selecting the turn mode, the level of the turn mode selection signal TM is set to "1", while the level of the up mode selection signal UM is set to "0". In the tunr mode, the increment and decrement in tone pitch is repeatedly carried out; however, it should be noted that the tone pitch is increased when the chord pyramid counter 222 and the octave counter 261 are placed in the up-down mode, while the tone pitch is decreased when these counters are placed in the down-count mode.

Figure 17:
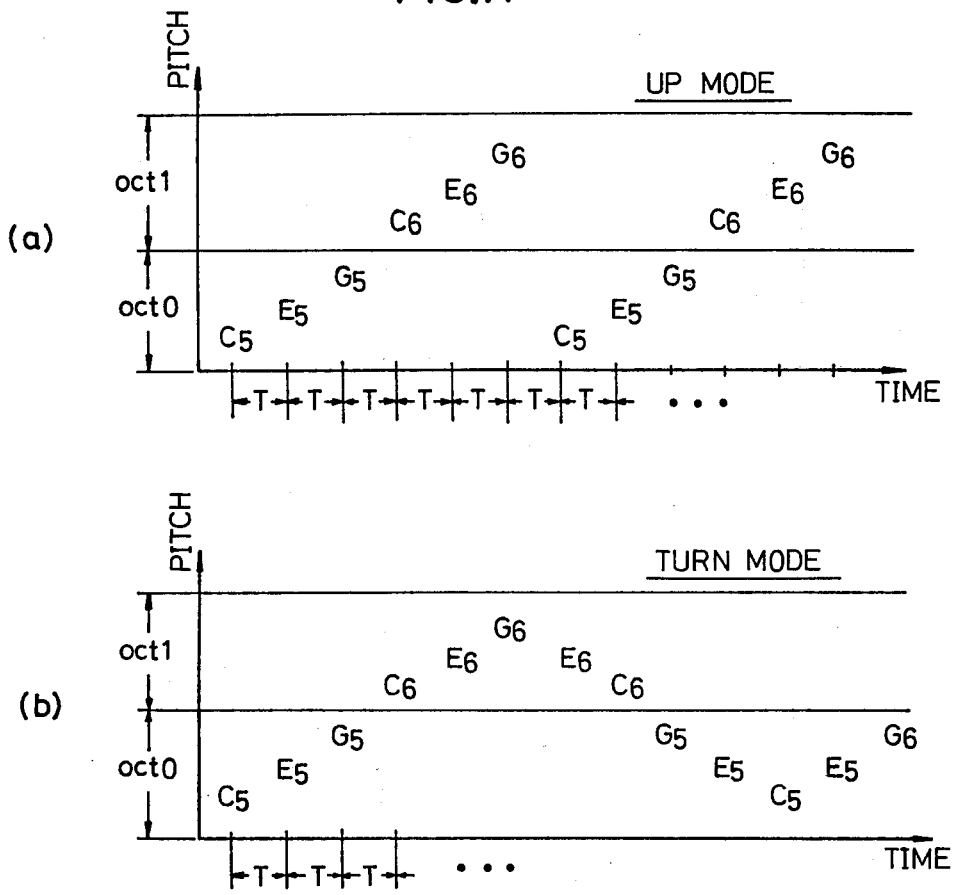
FIG. 17 is a graphical representation indicating examples of the produced tone variation which is automatically effected in this invention.

The part (b) of FIG. 17 indicates an example of a tone production state in the case where three tones ($C_5$, $E_5$ and $G_5$) automatically formed are subjected to tone production control in the turn mode. In this example shown in the part (b) of FIG. 17, the octave sliding data is set to "1" so that the increment and decrement in tone pitch is repeatedly carried out over two octaves.

Referring to the part (b) of FIG. 17, the tone pitch decreasing performance is carried out after the turning point on the highest tone side in the variations of tone pitch increment and decrement, while the tone pitch increasing performance is carried out after the turning point on the lowest tone side. The turning point on the highest tone side occurs when the present octave sliding data of a produced tone coincides with the set octave sliding data. On the other hand, the turning point on the lowest tone side occurs when the octave sliding data of a produced tone is "0", that is, the octave range is as specified by the key code. The variation in tone pitch in the chord pyramid performance reaches the turning point, the count modes of the chord pyramid counter 222 and the octave counter 261 are switched, so that the increment or decrement in tone pitch is effected. In this example, the circuitry is so designed that the same tone is not produced twice at the turning point when the pitch is increased or decreased.

The control peculiar to the turn mode as described above is effected when the carry signal CARY is provided in the count scanning operation of the chord pyramid counter 222 after the production of a tone corresponding to the turning point (the highest or lowest tone in the chord pyramid performance).

First, the processing of the carry signal at the turning point at which the increment in tone pitch is changed to the decrement in tone pitch will be described with reference to the column of a time region nT in FIG. 16.

When the octave sliding data (represented by the octave switching designation signal FF) of a chord pyramid tone being performed is coincident with the octave sliding data set by the signal $OSE_1$, $OSE_2$, the octave coincidence signal OSEQ is provided as described above. Since the tone pitch is being increased, the output level of the up-down control memory 249 is at "0", while the level of the up-count instruction signal is at "1". In addition, the turn mode selection signal TM is also at "1". Therefore, the AND circuits 307 and 310 in the octave up/down control circuit 303 (FIG. 15) have been enabled. If, under this condition, the tone corresponding to the turning point, i.e., the highest out of the three tones automatically formed is produced at a tone pitch which is obtained by increasing its octave as much as the set octave sliding data, the key code $N_1$-$B_3$ of this highest tone is stored in the coincidence code memory circuit 253 (FIG. 13). For instance, if it is assumed that as indicated in the part (b) of FIG. 17, the set octave sliding data is "1" and the highest tone is of note $G_5$, the tone of note $G_6$ higher by one octave than note $G_5$ is produced as the highest tone, and the key code $N_1$-$B_3$ of note $G_5$ has been stored in the coincidence code memory circuit 253.

When it comes to the next tone production timing in response to the production of the tone production timing pulse TEP, as was described before the count scanning operation of the chord pyramid counter 222 is started again, and the count value of the counter 222 is increased with the timing of the count pulse $J_1$ starting from the value obtained by adding one (1) thereto with respect to the highest tone's key code $N_1$-$B_3$. When the count value of the counter 222 reaches the maximum value without producing the coincidence signal CON, the carry signal CARY is produced through the AND circuit 294, and the octave switching pulse having a time width of 12 microseconds is outputted through the AND circuit 300. In addition, in one microsecond of the system clock pulse $SY_1$, the output $H_1$ of the flip-flop 254 is raised to "1". At the same time, the signal "1" is stored in the delay flip-flop 331 through the AND circuit 332, and the output H is raised to "1" in one microsecond of the system clock pulse $SY_1$ (cf. the part (p) of FIG. 16).

As is apparent from the column of time region nT in FIG. 16, the level of the octave switching pulse TRIG is raised to "1" 12 microsecond before the levels of the signals $H_1$ and H are raised to "1". When the level of the signal $H_1$ is raised to "1", the AND circuit 300 is disabled, and therefore the pulse TRIG disappears. This octave switching pulse TRIG is delayed by one microsecond by the flip-flop 302 in FIG. 15, and is applied to the AND circuits 307 and 310 which have been disabled as described before, as a result of which an output "1" having a time width of 12 microseconds is produced. The output "1" having a time width of 12 microseconds of the AND circuit 307 is applied to the adder 326 in the up-down control memory 249 through the OR circuit 328 and the count input line 327. The coun content of the memory 249 has been "0", and as a signal "0" is applied from the shift register 333 to the other input of the adder 326, the output of the adder 326 is raised to "1" and is then applied through the AND circuit 260 to the shift register 334 where it is stored. When this signal "1" is delayed by 12 microseconds by the 10-stage shift register 334 and the 2-stage shift register 333 and is applied to the adder 326, the signal "1" having a time width of 12 microseconds on the count output line 327 is lowered to "0", whereby thereafter the signal "1" is maintained stored in all of the twelve stages of the shift registers 334 and 333. The output of the shift register 334 is changed into an up/down count instruction signal $\overline{U}/D$ by a 2-stage shift register 335. This signal $\overline{U}/D$ becomes a signal "1" 13 microseconds after the decaying of the pulse TRIG as indicated in the part (q) of FIG. 17. Thus, while the down-count instruction signal D has "1", the up-count instruction signal U has "0", and the count modes of the octave counter 261 and the chord pyramid counter 222 are switched to the down-count modes.

In response to the octave switching pulse TRIG delayed by one microsecond a turning pulse TP having a time width of 12 microseconds (the part (r) of FIG. 16) is outputted by the AND circuit 310. This pulse TP is applied through an OR circuit 336 and a line 337 to an AND circuit 338 in FIG. 13. When (1) the carry signal CARY is at "1", (2) the turn mode section signal TM applied through the line 325 by the octave up/down control circuit 303 is at "1" (3) the signal $\overline{H}$ obtained by inverting the output H of the flip-flop 331 by the inverter 339 is at "1", and (4) the turning pulse TP is at "1", then (5) the AND circuit 338 outputs a pluse $LOAD_1$ having a time width of one microsecond with the timing of the system clock pulse $SY_1$. In other words, when the level of the output of the AND circuit 332 is raised to "1" with the timing of the system clock pulse $SY_1$ (in this case the signal H is still at "0", and the signal $\overline{H}$ is at "1"), the level of the output of the AND circuit 338 is raised to "1" and therefore the writing instruction pulse $LOAD_1$ having a time width of one microsecond (the part (s) of FIG. 16) is generated.

The writing instruction pulse $LOAD_1$ is applied to the writing control input of the chord pyramid counter 222, so that the key code of the highest tone (for instance, note $G_5$) produced at the turning point and stored in the coincidence code memory circuit 253 is written in the counter 222. Thus, the data equal to the key code $N_1$-$B_3$ of the highest tone is preset in the counter 222 and the carry signal CARY is cancelled. When the carry signal CARY has "0", the output of the NAND circuit 340 is raised to "1". In addition, when the carry signal CARY has "0", the signal $\overline{H}$ is raised to "1". This signal H is applied through the AND circuit 341 and the OR circuit 342 to the flip-flop 331, where it self-held. More specifically, when the output of the NAND circuit 340 is at "1" and a inverted signal $\overline{CON}$ obtained by inverting the coincidence signal CON by the inverter 267 is at "1", the signal H is self-held by the AND circuit 341. The output of the NAND circuit 340 is at "0" with the timing where the carry signal CARY coincides with the system clock pulse $SY_1$, and it is at "1" in the other cases. Therefore, the signal H is self-held until the coincidence signal CON is provided by the AND circuit 230. The reason why the signal H is decayed in 12 microseconds in the column of time region 4T in FIG. 16 is that the output level of the NAND circuit 340 is lowered to "0" because of the coincidene of the carry signal CARY with the pulse $SY_1$.

Where the previous coincidence code is written in the chord pyramid counter 222 with the aid of the writing instruction pulse $LOAD_1$, during the succeeding 12 microseconds the coincidence detection signal COIN is provided by the coincidence detection circuit 221. However, in this case, as the AND circuit 230 has been disabled, the coincidence detection signal COIN is not outputted by the AND circuit 230. However, if the system clock pulse $SY_1$ is provided at the end of the signal $H_1$ having a time width of 12 microsecond, then the flip-flop 255 is set by the pulse applied through the AND circuit 314, and in one microsecond after this the signal $H_2$ is raised to "1" to enable the AND circuit 230. Therefore, the AND circuit 313 is caused to provide the count pulse $J_3$ under the same operating conditions as those of the AND circuit 314 before the signal $H_2$ is raised to "1", thereby to advance the count value of the counter 222 by one step. In this case, the counter 222 has been placed in the down-count mode already (cf. the part (q) of FIG. 16). Therefore, upon application of the pulse $J_3$, the value one (1) is subtracted from the previous coincidence code, i.e., the value of the key code of the highest out of the tones of keys being depressed. Immediately after the subtraction of the value one (1), the level of the signal $H_2$ is raised to "1", as a result of which the count scanning operation of the counter 222 is started again. However, this count scanning operation is for decreasing the count value of the counter 222.

As is apparent from the above description, when the turning pulse TP is applied during the processing of the carry signal at the turning point, the content of the counter is replaced by the previous coincidence code (the key code of a tone produced at the turning point), and after the content of the counter 222 is advanced by one step the count scanning operation is started for the generation of the coincidence signal CON. Therefore, jumping over the key code of the highest tone generated at the turning point, the count scanning operation is carried out, and accordingly the highest tone will never be produced twice.

As the count value of the counter 222 is successively reduced by the count pulse $J_1$, the count value of the counter 222 reaches a value corresponding to the key code of a key (note $E_5$ for instance) below the key of the highest tone, whereupon the coincidence signal CON is produced. The coincidence signal CON provided by the AND circuit 230 is inverted by the inverter 267 and is applied to a 1-input AND circuit 343. Accordingly, the output of the AND circuit 343 is lowered to "0" with the timing of generation of the coincidence signal CON, and therefore the self-holding of the signal H passed through the AND circuit 341 and the OR circuit 342 is released. In addition, with the aid of this coincidence signal CON, the chord pyramid tone production instruction signal CCF is generated to produce the n-th tone. The coincidence signal CON enables the AND circuits 272 and 273 in the octave memory circuit 248 (FIG. 15), so that the memory content of the relevant channel in the memory circuit 248 is rewritten into the content of the counter 261. However, it should be noted that the content of the counter 261 represents the set maximum octave sliding data because the count mode of the octave counter 261 is switched (from up-count to down-count) but no count pulse is applied thereto. Therefore, in the case where the set octave sliding data is "1", the tone of note $E_6$ higher by one octave than note $E_5$ is produced.

Since the count scanning operation of the chord pyramid counter 222 is continued to decrease the count value thereof, the coincidence signals CON are generated in the order of decreasing tone pitch, as a result of which the tones are produced in the order of decreasing tone pitch; that is, the tone pitch of the tone produced is successively decreased.

On the other hand, in the carry detection circuit 256 in FIG. 13, the NOR circuit 295 has been enabled by the level "0" of the up-count signal U, and therefore when the count value of the chord pyramid counter 222 reaches the minimum value "0000000", the output of the NOR circuit 295 is raised to "1" to generate the carry signal. The processing of the carry signal CARY during the tone pitch decrement is carried out substantially similarly to that of the carry signal CARY carried out during the tone pitch increment (cf. the column of time region 4T in FIG. 14, as guidance). Only the difference between these two cases is that the octave counter 261 is set in the down-count mode by the down-count instruction signal D. When the octave switching pulse TRIG is provided in response to the carry signal CARY, the output "1" is provided by the AND circuit 305 in response to the pulse TRIG because the AND circuit 305 has been enabled under the conditions that (1) the octave up/down count instruction signal D is at "1" and (2) an octave sliding data "0" detection signal ZR is at "0" (the output of the inverter 344 being at "1"). Therefore, the count pulse is applied to the octave counter 261, and the value one (1) is subtracted from the count value of the counter 261. In this manner, in the case of the tone pitch decrement the content of the octave counter 261 is successively decreased in response to the carry signal CARY, and the octave sliding data specified in the performance is sequentially decreased. Thus, the successive decrement in tone pitch from the turning point on the highest tone side toward the turning point on the lowest tone side is effected.

The processing of the carry signal at the turning point where the tone pitch decrement is changed to the tone pitch increment (or the turning point on the lowest tone side) is carried out substantially similarly as in the case of the turning point on the highest tone side (cf. the column of time region nT in FIG. 16, as guidance). In the process of the count scanning operation effected after the production of the lowest tone (note $C_5$ in the example of the part (b) of FIG. 17), the key code of the previously produced tone, or $C_5$, has been stored in the coincidence code memory circuit 253. In addition, since the octave sliding data is "0", the output of the octave number 261 is "0 0", which is inverted into "1 1" by the inverters 318 and 319 to operate the AND circuit 345. As a result, the AND circuit 345 provides its output "1", which is applied, as an octave sliding data "0" detection signal ZR, to the AND circuits 308 and 309 in the octave up/down control circuit 303. When this octave sliding data "0" detection signal ZR is at "1", it indicates that the chord pyramid performance is effected in the octave range including the turning point on the lowest tone side, that is, the octave range as represented by the key code KC.

The AND circuit 308 is enabled when (1) the turn mode selection signal TM is at "1", (2) the down-count instruction signal D is at "1", and (3) the octave sliding data "0" detection signal ZR is at "1". When under this condition the octave switching pulse TRIG is applied to the AND circuit 308, the latter 308 produces its output "1" having a time width of 12 microseconds. When (1) the down-count instruction signal D is at "1", and (2) the octave sliding data "0" detection signal ZR is at "1", the AND circuit 309 is enabled, and this AND circuit 309 provides its output "1" having a time width of 12 microseconds in response to the octave switching pulse TRIG applied thereto.

As was described above, the carry signal CARY causing the chord pyramid counter 222 to have the minimum value is applied to the chord pyramid system control section 232, and the octave switching pulse TRIG is produced. The pulse having a time width of 12 microseconds which is outputted by the AND circuit 309 in response to this pulse TRIG, is applied, as a turning pulse TP, to the chord pyramid system control section 232 (FIG. 13) through the OR circuit 336 and the line 337 (FIG. 15). When the turning pulse TP is being produced, the writing instruction pulse $LOAD_1$ is outputted by the AND circuit 338 with the timing of the system clock pulse $SY_1$, so that the previous coincidence code (the key code $N_1$-$B_3$ of the lowest tone $C_5$) stored in the coincidence code memory circuit 253 is written into the chord pyramid counter 222.

On the other hand, the signal "1" having a time width of 12 microseconds which has been produced by the AND circuit 308 (FIG. 15) in response to the octave switching pulse TRIG is applied through the OR circuit 328 and the line 327 to the adder 326 in the up-down control memory 249. As the storage in the memory 249 has been "1" during the tone pitch decrement, the signal "1" is applied to the adder 326 by the shift register 333. Therefore, the output of the 1-bit adder 326 will have 1+1="0", and this signal "0" is stored in the memory 249. Thus, when the up-count instruction signal U is raised to "1", the counters 222 and 261 are placed in the up-count modes.

The count pulse $J_3$ is outputted by the AND circuit 313 (FIG. 13) in 12 microseconds after the previous coincidence code (the key code of the lowest tone $C_5$) is written into the chord pyramid counter 222; however, as the count mode of the counter 222 has been switched to the up-count mode, the value one (1) is added to the previous coincidence code, and one microsecond thereafter the signal $H_2$ is raised to "1", as a result of which the counter 222 is set to be ready for count scanning operation. In this case, the count values of the counters 222 and 261 are increased, and therefore the tone pitch increment is effected similarly as in the above-described case.

In the above-described example, this invention is practiced by utilizing the part of "single finger function" in the automatic bass chord performance control device 14; however, it should be noted that this invention is not limited thereto or thereby. That is, for instance, the electronic musical instrument according to this invention may be obtained by providing only the circuit shown in FIGS. 7, 8 and 9 (without the automatic bass chord function).

Furthermore, the provision of the second musical tone forming system 16 is not always necessary. That is, it may be eliminated when it is unnecessary to have an effect of automatically chopping a chord. However, it should be noted that if the electronic musical instrument according to this invention is constituted by adding the automatic bass chord function as indicated in FIG. 1, the automatic bass chord performance effect in addition to the effects obtained by this invention can be obtained. In this case, merely by depressing a single key in the lower keyboard, a chord pyramid effect as arpeggio, an automatic chord chopping effect, and an automatic bass performance effect can be obtained simultaneously.

As is apparent from the above description, according to the invention, by selecting a key in a keyboard, a plurality of tones which are in predetermined interval relation to the tone of the selected key are automatically and successively produced, whereby a performance effect such as arpeggio can be obtained by very simple operation.

What is claimed is:

1. An electronic musical instrument comprising:

(a) first means for producing, according to information representative of the note name of a single depressed key, key information representative of the note names of a plurality of tones which are in predetermined non-octave, chord interval relations to the tone of said key;

(b) second means for detecting said key information successively at predetermined time intervals; and (c) third means for producing tones corresponding to the key information detected by said detection means in response to the detection thereof, one at a time over plural octaves.

2. An electronic musical instrument as defined in claim 1 wherein said first means comprises:

a first circuit for providing information representing the note name and octave of a single key among one or more depressed keys;

a second circuit for producing a set values controlling said chord interval relations; and a third circuit combining the information representing said single key provided by said first circuit and each of the set of values produced by said second circuit and outputting, as a result of said combining, a plurality of key information each of which represents the note name and octave of a tone that is in a predetermined chord interval relation with the tone of said single key, said chord interval relations being established by the set of values provided by said second circuit.

3. An electronic musical instrument as defined in claim 2 wherein said first circuit comprises:

a circuit for detecting a key for the highest or lowest tone from among one or more keys being depressed in a predetermined keyboard; and a circuit for storing information representative of the detected single key, said information representative of the detected single key being provided to said third circuit.

4. An electronic musical instrument as defined in claim 2 wherein said second circuit is a circuit capable of selectively generating a set of values which are in a desired chord interval relation among plural sets of values corresponding to plural sets of chord intervals and said selective generation is effected in accordance with a signal designating a desired chord type.

5. An electronic musical instrument as defined in claim 2 wherein said second circuit comprises:

a chord interval value memory prestoring plural value information corresponding to plural chord intervals;

chord type selection means for designating a type of chord interval relation between a plurality of tones;

a circuit for designating to said chord interval value memory a set of chord intervals corresponding to the designated chord type; and readout circuit for reading value information corresponding to the designated set of chord intervals from said chord interval value memory.

6. An electronic musical instrument as defined in claim 5 wherein said readout circuit is a circuit sequentially supplying read out value information in accordance with each interval of the designated set of chord intervals, value information corresponding to each interval of the set of chord intervals being sequentially read from said chord interval value memory, said third circuit combining each value information and the single key information in accordance with the order of said reading out so that said plural key information is serially produced.

7. In an electronic musical instrument of the type wherein plural digital key codes representing the note names of musical tones to be generated are maintained in a channel processor and supplied to a common tone generator in timed shared order, said tone generating producing said plural musical tones in corresponding time shared order, the improvement for implementing single finger chord pyramid arpeggio effects comprising:

subtone forming data generator means for accepting the key code of a single depressed key and producing therefrom a set of key codes representing the note names of tones of a musical chord based on the tone of said single depressed key as a prime, said chord-representative set of key codes being provided to said channel processor for maintenance therein, and chord pyramid performance control means, connected to said channel processor and said tone generator and responsive to said key codes supplied in time shared order from said channel processor, for enabling said tone generator to produce chord tones corresponding to said chord-representative key codes sequentially in a selected arpeggio order.

8. An electronic musical instrument according to claim 7 wherein said tone generator includes:

time shared envelope generator means for establishing the amplitude envelope of each tone produced in time shared order by said tone generator, and wherein said chord pyramid performance control means includes:

coincidence detection means for determining at each time sharing interval whether the key code currently being supplied to said tone generator corresponds to the chord-representative key code for the chord tone presently to be produced in said selected arpeggio order, and if so, for producing during the same time sharing interval a "chord pyramid tone production instruction" signal to enable said envelope generator, and producing no such "chord pyramid tone production instruction" signal during the time sharing intervals containing all other chord-representative key codes.

9. An electronic musical instrument according to claim 7 wherein said tone generator includes:

footage change means for changing the footage of the tone being generated, and wherein said chord pyramid performance control means includes:

octave control means for providing to said foot changed means control signals for modifying, in accordance with said selected arpeggio order, the octave in which said enabled chord tone is produced.

10. An electronic musical instrument according to claim 8 further comprising:

tone production timing pulse generation means for providing arpeggio timing pulses at a selectable arpeggio clock rate, said chord pyramid performance control means enabling production of the next sequential chord tone upon occurrence of each provided arpeggio timing pulse, and wherein said chord pyramid performance control means includes:

an up/down counter for cycling through a sequence of digital key codes upon occurrence of each arpeggio timing pulse and for stopping when coincidence is detected between the digital key code in said up/down counter sequence and the chord-representative key code currently supplied from said channel processor, said cycling recurring upon occurrence of the next arpeggio timing pulse, and octave counter means, cooperating with said up/-down counter, for counting the number of repetitions of cycling by said up/down counter, said octave control means being responsive to the contents of said octave counter means.

* * * * *